US005961185A

United States Patent [19]

Friant et al.

[11] Patent Number: 5,961,185

[45] Date of Patent: Oct. 5, 1999

[54] SHIELDED CUTTERHEAD WITH SMALL ROLLING DISC CUTTERS

[75] Inventors: James E. Friant, Seattle, Wash.; Levent Ozdemir, Golden, Colo.

[73] Assignee: Excavation Engineering Associates, Inc., Seattle, Wash.

[ * ] Notice: This patent is subject to a terminal disclaimer.

[21] Appl. No.: 08/852,003

[22] Filed: May 6, 1997

Related U.S. Application Data

[62] Division of application No. 08/125,011, Sep. 20, 1993, Pat. No. 5,626,201.

[51] Int. Cl.[6] ..... E21B 10/12; E21D 9/10

[52] U.S. Cl. ..... 299/33; 175/365; 175/369; 175/373

[58] Field of Search ..... 299/33, 55, 56, 299/110; 175/373, 350, 351, 365, 369, 370, 371, 372, 374; 405/138, 141

[56] References Cited

U.S. PATENT DOCUMENTS

| | | | |
|---|---|---|---|
| Re. 28,625 | 11/1975 | Cunningham | 384/96 |
| 1,090,952 | 3/1914 | Vandergriff | 175/372 |
| 2,174,102 | 9/1939 | Catland | 175/228 |
| 2,223,864 | 12/1940 | Zublin | 175/373 |
| 2,704,204 | 3/1955 | Koontz | 175/374 X |
| 2,886,293 | 5/1959 | Carr et al. | 175/374 X |
| 3,596,724 | 8/1971 | Bechem | 175/369 X |
| 3,766,998 | 10/1973 | Bower, Jr. | 175/373 |
| 3,778,107 | 12/1973 | Haspert | 299/33 X |
| 3,786,879 | 1/1974 | Murdoch | 175/374 |
| 3,791,465 | 2/1974 | Metge | 175/373 |
| 3,981,370 | 9/1976 | Bingham et al. | 175/373 |
| 4,102,419 | 7/1978 | Klima | 175/371 |
| 4,234,235 | 11/1980 | Robbins et al. | 299/56 |
| 4,298,080 | 11/1981 | Hignett | 175/373 |
| 4,339,009 | 7/1982 | Busby | 175/374 |
| 4,359,114 | 11/1982 | Miller et al. | 175/344 |
| 4,359,335 | 11/1982 | Garner | 419/6 |
| 4,427,081 | 1/1984 | Crawford | 175/376 |
| 4,452,325 | 6/1984 | Radd et al. | 175/426 |
| 4,549,614 | 10/1985 | Kaalstad et al. | 175/339 |
| 4,562,892 | 1/1986 | Ecer | 175/371 |
| 4,592,252 | 6/1986 | Ecer | 76/108.2 |
| 4,722,405 | 2/1988 | Langford, Jr. | 175/374 |
| 4,784,438 | 11/1988 | Fikse | 299/110 |
| 4,793,427 | 12/1988 | Lambson et al. | 175/373 |
| 4,802,539 | 2/1989 | Hall et al. | 175/371 |
| 4,804,295 | 2/1989 | Kondo | 405/141 |
| 4,817,742 | 4/1989 | Whysong | 175/420.1 |
| 4,817,743 | 4/1989 | Greenfield et al. | 175/435 |
| 4,874,047 | 10/1989 | Hixon | 175/369 |
| 4,911,255 | 3/1990 | Pearce | 175/368 |
| 4,991,671 | 2/1991 | Pearce et al. | 175/369 |
| 5,040,624 | 8/1991 | Schumacher et al. | 175/371 |
| 5,064,007 | 11/1991 | Kaalstad | 175/334 |
| 5,080,183 | 1/1992 | Schumacher et al. | 175/371 |
| 5,145,017 | 9/1992 | Holster et al. | 175/333 |
| 5,147,000 | 9/1992 | Kaalstad | 175/334 |
| 5,234,064 | 8/1993 | Lenaburg | 175/373 |
| 5,325,932 | 7/1994 | Anderson et al. | 175/325.3 |
| 5,465,800 | 11/1995 | Pearce et al. | 175/368 |
| 5,513,711 | 5/1996 | Williams | 175/57 |
| 5,513,715 | 5/1996 | Dysart | 175/371 |
| 5,518,077 | 5/1996 | Blackman | 175/353 |
| 5,560,440 | 10/1996 | Tibbitts | 175/384 |
| 5,570,750 | 11/1996 | Williams | 175/371 |
| 5,582,258 | 12/1996 | Tibbitts et al. | 175/57 |
| 5,586,611 | 12/1996 | Dorosz | 175/369 |
| 5,636,700 | 6/1997 | Shamburger, Jr. | 175/331 |

FOREIGN PATENT DOCUMENTS

| | | | |
|---|---|---|---|
| 2449405 | 4/1976 | Germany | 175/373 |

*Primary Examiner*—David J. Bagnell
*Attorney, Agent, or Firm*—R. Reams Goodloe, Jr.

[57] ABSTRACT

An improved disc type rolling rock cutter, and novel cutterheads employing such cutters. A rock cutter with an improved, simplified structure, with compact bearing, and smooth, rounded blade shape is disclosed. The design incorporates a cutter ring, bearing, and seal into a single cutter ring assembly. The cutter may be assembled and disassembled for rework by a single worker with simple hand tools. Replacement of worn out cutter rings is done quickly and easily by removing the old ring assembly and then sliding a new ring, bearing, and seal assembly on to the cutter shaft. This simplified assembly is achieved by using a comparatively large shaft which is normally in the range of 40–50% of the ring diameter. The shaft design is sufficiently robust to permit a cantilever mount of the cutter. The unique configuration allows 30,000 lbs. or more thrust to be applied to a 5 inch diameter miniature disc. This capacity permits single disc cutter technology to be applied to smaller bits or cutterheads than previously possible. Also, a unique method of shaping and installing hard metal inserts improves cutting efficiency over the life of the cutter, and increases wear life in highly abrasive conditions.

60 Claims, 17 Drawing Sheets

322
318
316
302
18B
330
318
316
320
318
316
284
312
R8
18B
R2
302
310
298
R1
R9
320
322
302
320
322
314
284

320
318
322
R6
312
R2
310
R4
R1
R2'
314
302
R3
316
330
318
R5
322
R2'

190
146
140
156
L
154
189
158
138
188
191
134
150
152
122
128
120
130
132
182
136
124
174
176
180
198
196
196
192
423
194

SHIELDED CUTTERHEAD WITH SMALL ROLLING DISC CUTTERS

This application is a divisional of application Ser. No. 08/125,011 filed on Sep. 20, 1993, now U.S. Pat. No. 5,626,201, issued May 6, 1997.

TECHNICAL FIELD

This invention relates to tools for cutting rock and hard soils, and more particularly, to improved cutterheads employing novel small diameter disc cutters for use with drilling, boring, tunneling machines, and other mechanical excavation equipment.

BACKGROUND

A variety of cutter or bits are known in the art of mechanical excavation. One type of cutter commonly used on large diameter cutterheads in rock excavation is the disc type rolling cutter. Disc cutters are presently frequently used on cutterheads employed in tunnel boring, raise drilling, and large diameter blind drilling.

In hard rock, the disc type cutter operates on the principle that by applying great thrust on the cutter, and consequently pressure on the rock to be cut, a zone of rock directly beneath (i.e., in the cutting direction) and adjacent to the disc cutter is crushed, normally forming very fine particles. The crushed zone forms a pressure bulb of fine rock powder which exerts a hydraulic like pressure downward (again, the cutting direction) and outward against adjacent rock. The adjacent rock then cracks, and chips spall from the rock face being excavated.

The present invention is directed to a novel disc cutter which dramatically improves production rates of disc cutter excavation, which also allows reduced thrust requirements for cutterhead penetration, which in turn reduces the weight of the structure required to support the cutters. Such reductions also allow disc cutter technology to be applied to novel, small diameter cutterheads for excavation equipment. Additionally, the relatively light weight of our disc cutters provides dramatically decreased parts and labor costs for the maintenance and replacement of cutterhead wear parts.

BRIEF DESCRIPTION OF THE DRAWING

For a better understanding of the nature, objects and advantages of our invention, the general principles of its operation, and of the prior art pertaining thereto, reference should be had to the following detailed description, taken in conjunction with the accompanying drawing, in which.

Theory

Prior Art

Figure 6:
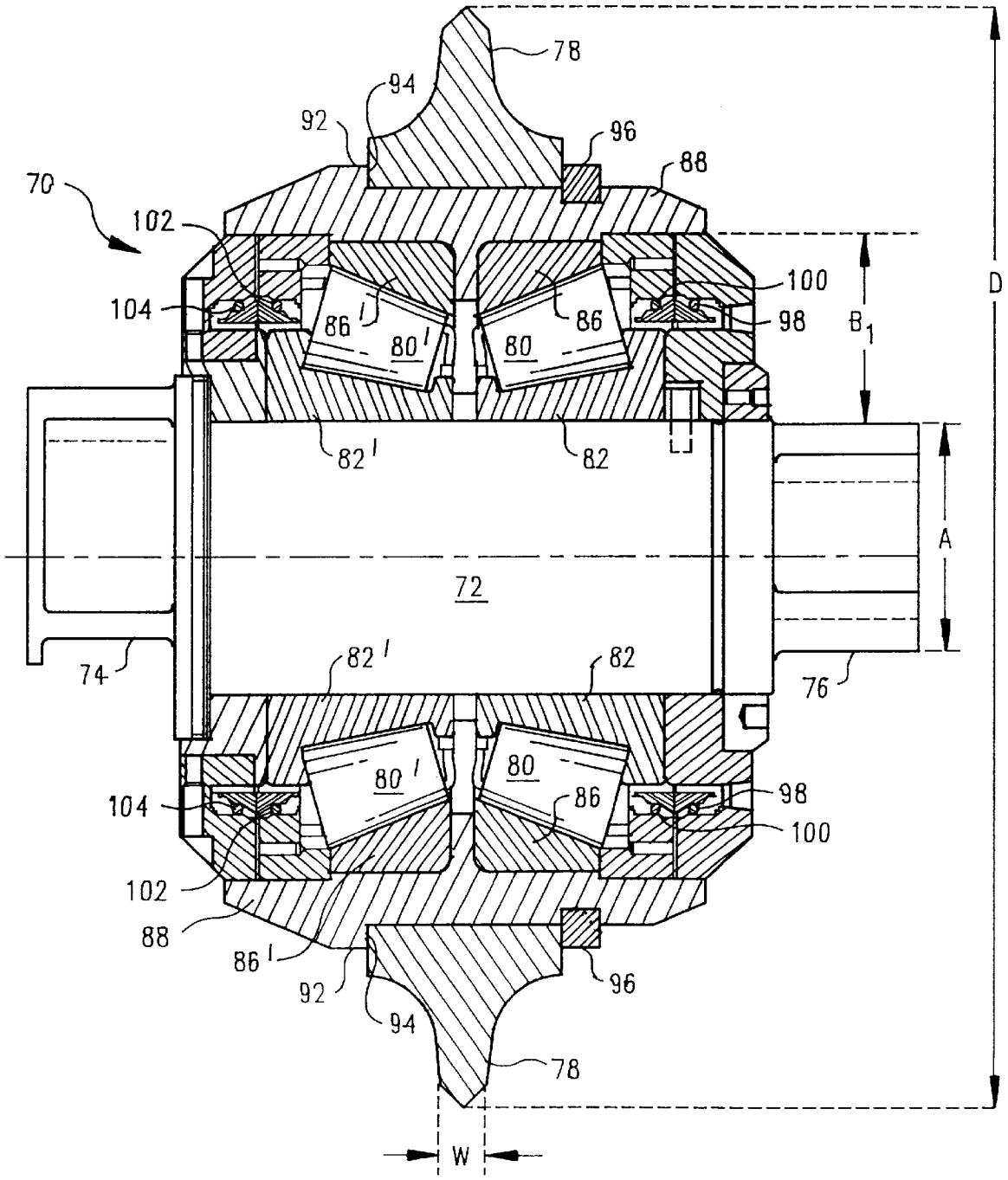
FIG. 6 (PRIOR ART)

FIG. 6 is a vertical cross-sectional view of a typical prior art rolling type disc cutter.

Novel Disc Cutter

Figure 7:
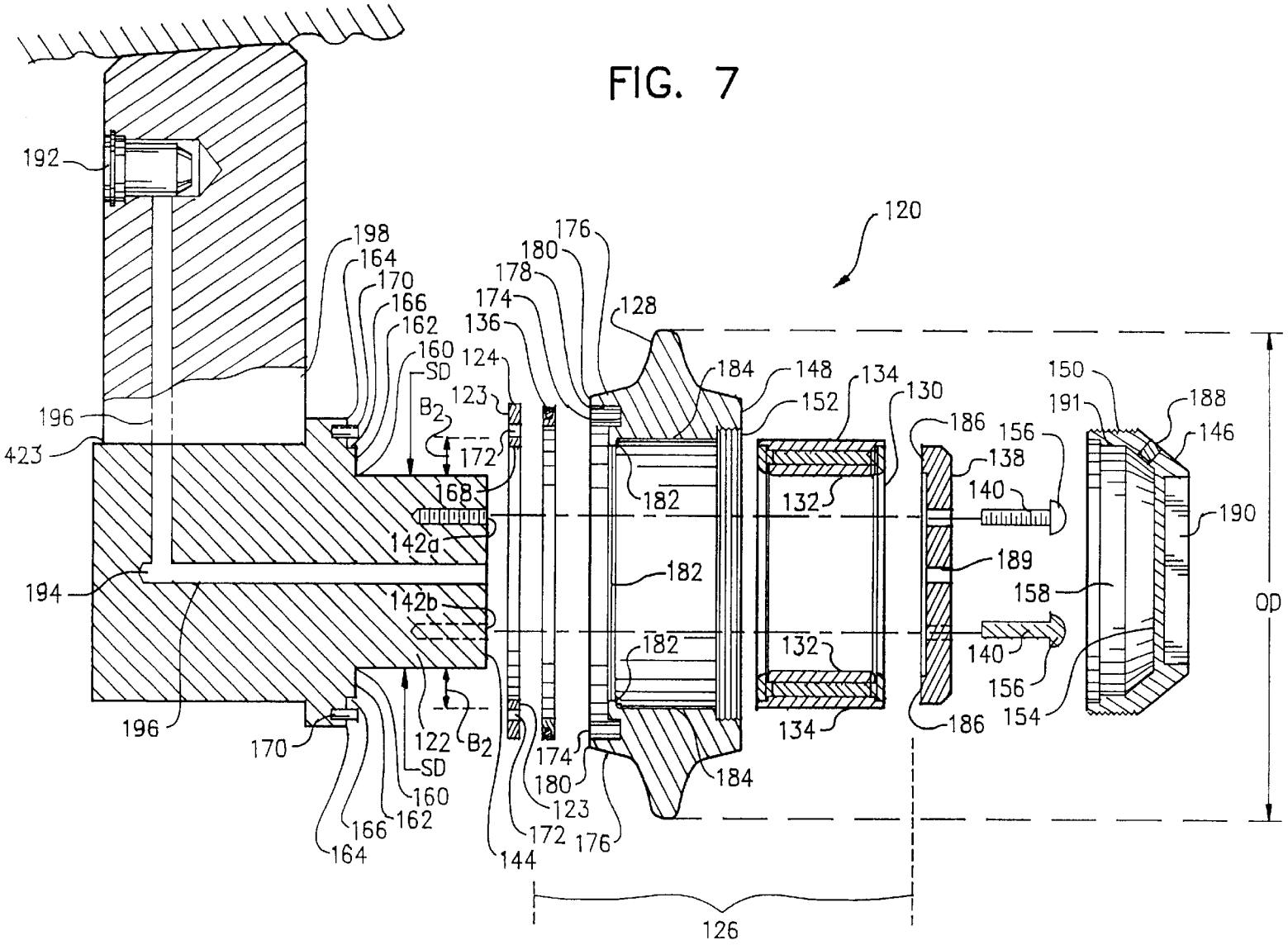

FIG. 7 is an exploded vertical cross-sectional view of the novel rolling type disc cutter of the present invention, revealing (a) a shaft, (b) wear ring, (c) seal, (d) cutter ring or blade, (e) bearing, (f) bearing retainer, and (g) hubcap, all assembled on a pedestal mount.

Figure 7A:
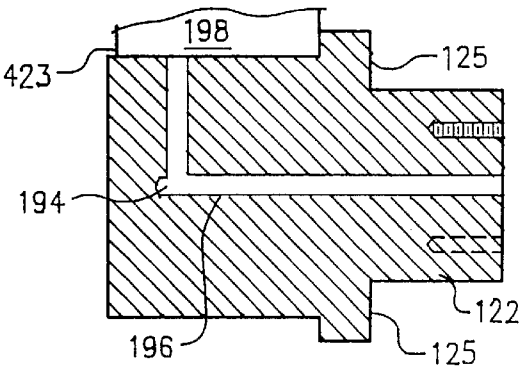

FIG. 7A is a cross-sectional view of a shaft for a rolling disc cutter, were the hardened washer surface is provided as an integral part of the shaft structure.

Figure 7B:
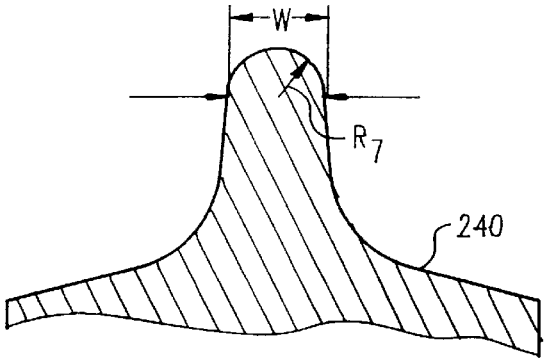

FIG. 7B is an enlarged vertical cross-sectional view of a substantially semi-circular shaped disc cutter ring as may be employed on our novel disc cutter.

Figure 8:
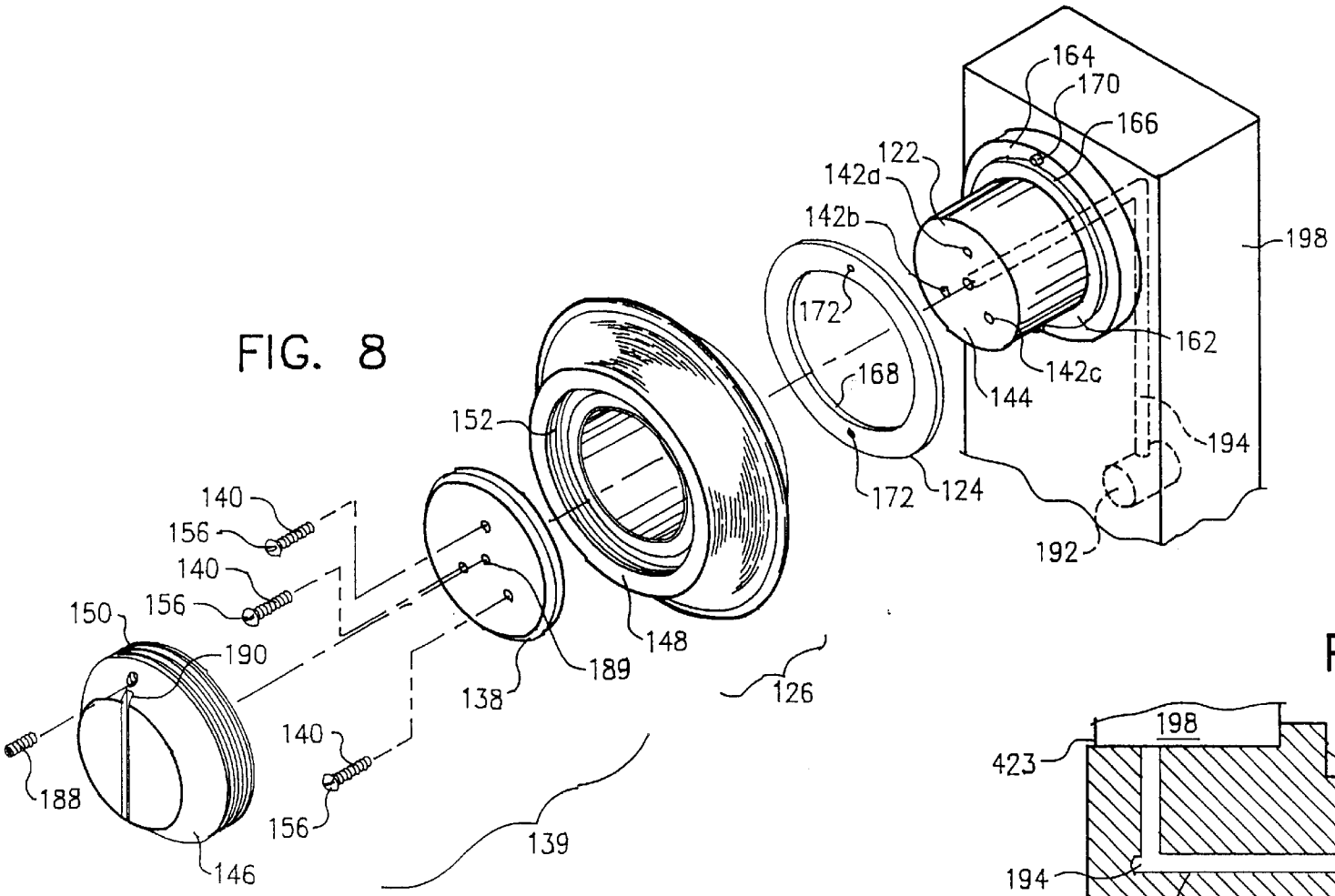

FIG. 8 is an exploded perspective view of the disc cutter assembly of the present invention, showing (a) a shaft, (b) wear ring, (c) cutter blade, with seal (not visible) and bearing assembled, (d) bearing retainer, and (e) hubcap, all assembled on a pedestal mount.

Figure 9:
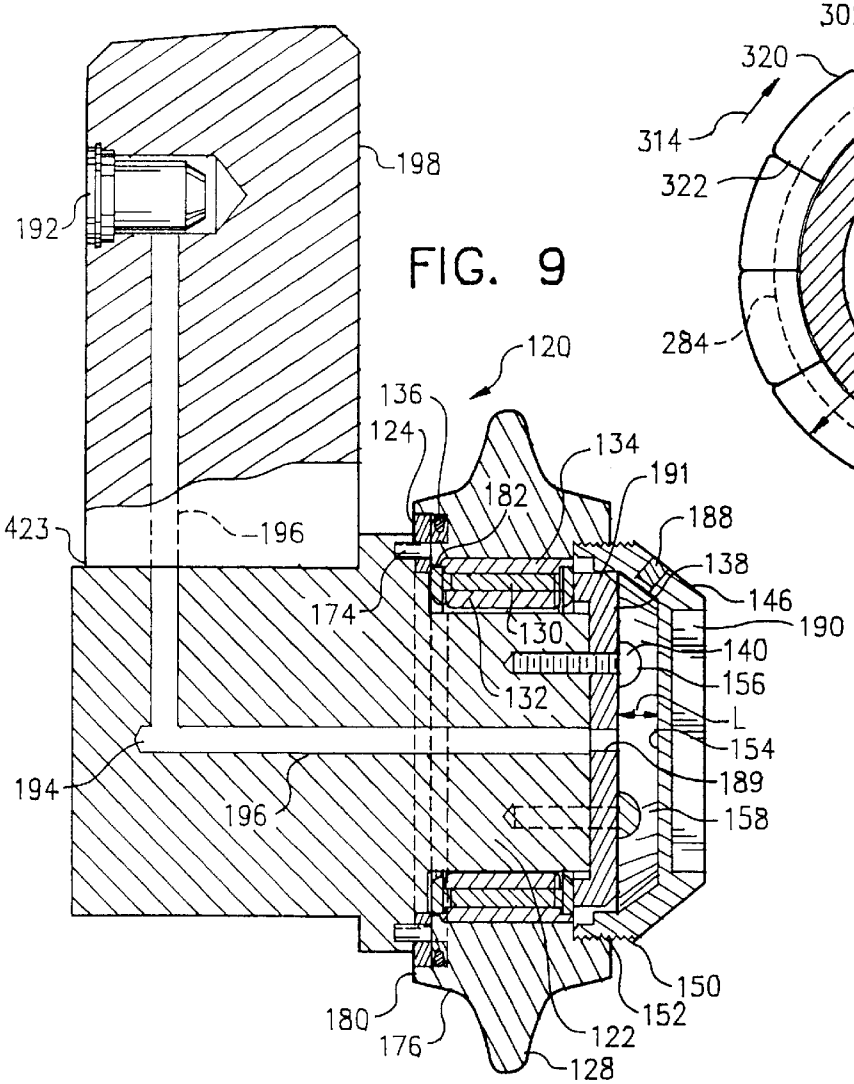

FIG. 9 is vertical cross-sectional view of a fully assembled disc cutter of the type illustrated in FIG. 7 and FIG. 8 above.

Test Apparatus

Figure 10:
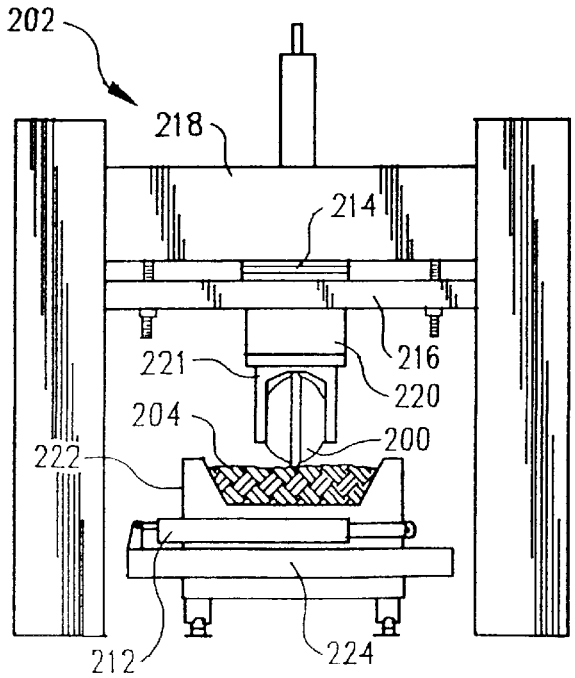

FIG. 10 is a schematic illustrating the testing apparatus used for gathering initial performance and structural data on our novel disc cutters.

Figure 11:
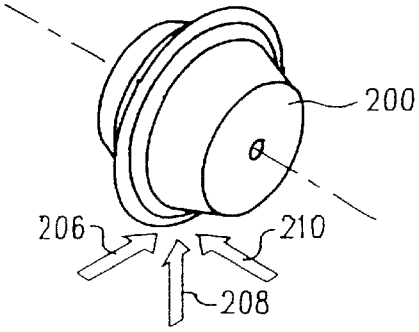

FIG. 11 is a schematic illustrating the forces acting on a disc cutter.

Figure 12:
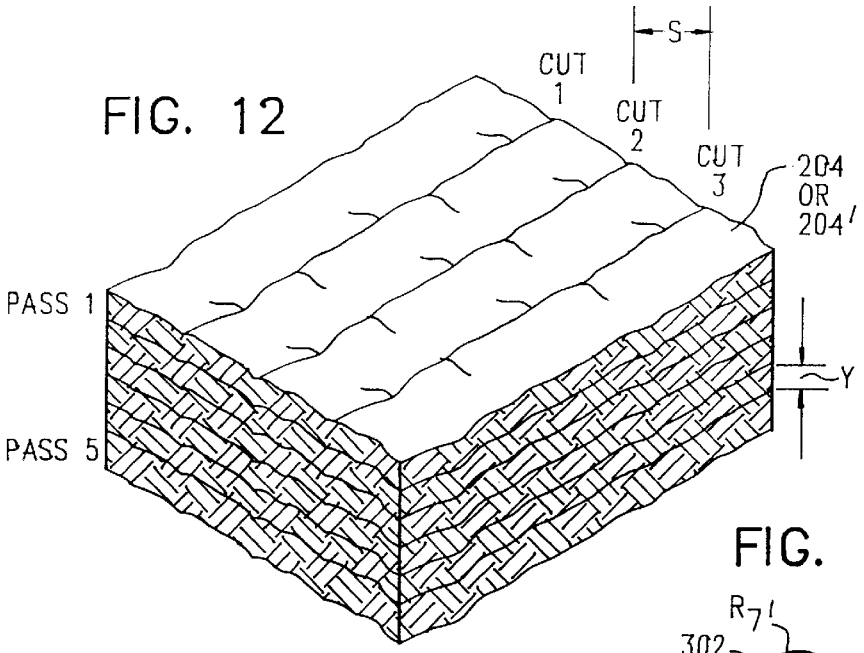

FIG. 12 is a schematic illustrating some of the important measurements with respect to work done on rock being cut with rolling disc cutters.

Cutter Blade Details

Figure 13:
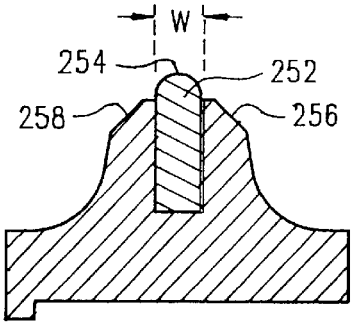

FIG. 13 is an axial cross-sectional view of an unused disc cutter utilizing a hard metal cutting blade insert.

Figure 14:
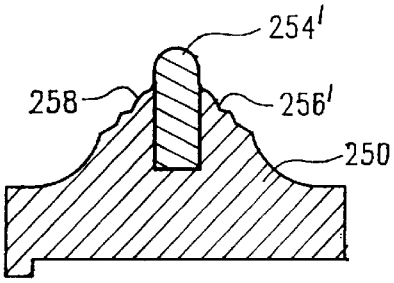

FIG. 14 is an axial cross-sectional view of an used disc cutter utilizing a hard metal cutting blade insert, showing the self sharpening cutter blade described herein.

Prior Art Cutter Blade Details

Figure 15:
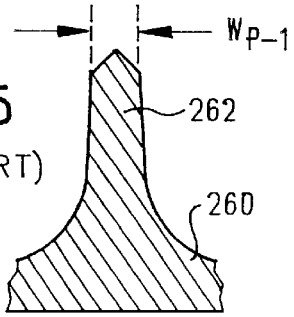
FIG. 15 (PRIOR ART)

FIG. 15 shows an axial cross-sectional view of an unused prior art all metal disc cutter blade.

Figure 16:
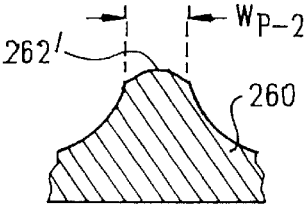
FIG. 16 (PRIOR ART)

FIG. 16 shows an axial cross-sectional view of a used prior art all metal disc cutter blade.

Figure 17:
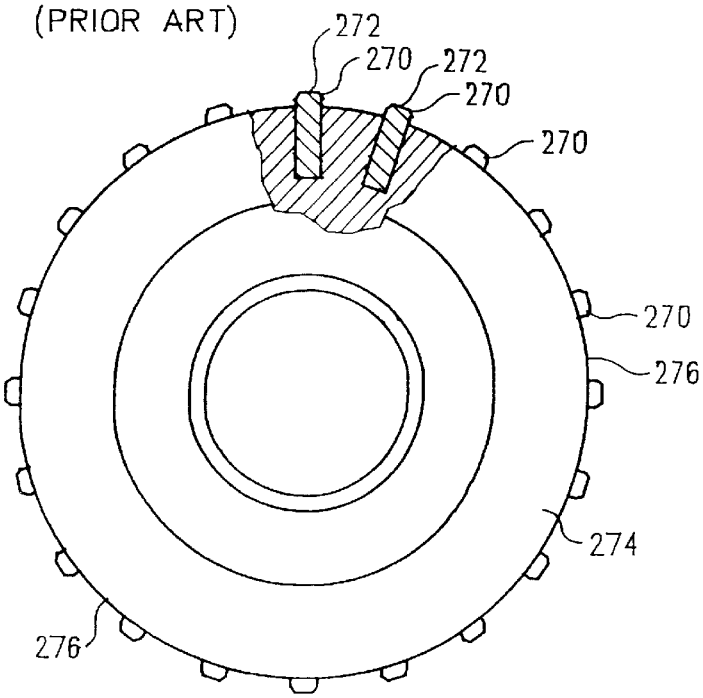
FIG. 17 (PRIOR ART)

FIG. 17 is a transverse view with a partial cut-away showing a cross-sectional view, illustrating a prior art disc cutter blade with button type hard metal inserts.

Figure 17A:
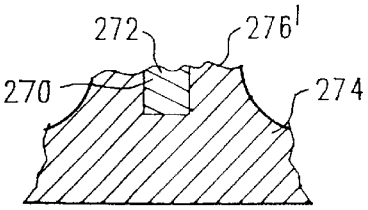
FIG. 17A (PRIOR ART)

FIG. 17A is an axial cross-sectional view showing the wear pattern of the button type hard metal insert found in some prior art disc cutter designs.

Hard Metal Cutter Blade Details

Figure 18:
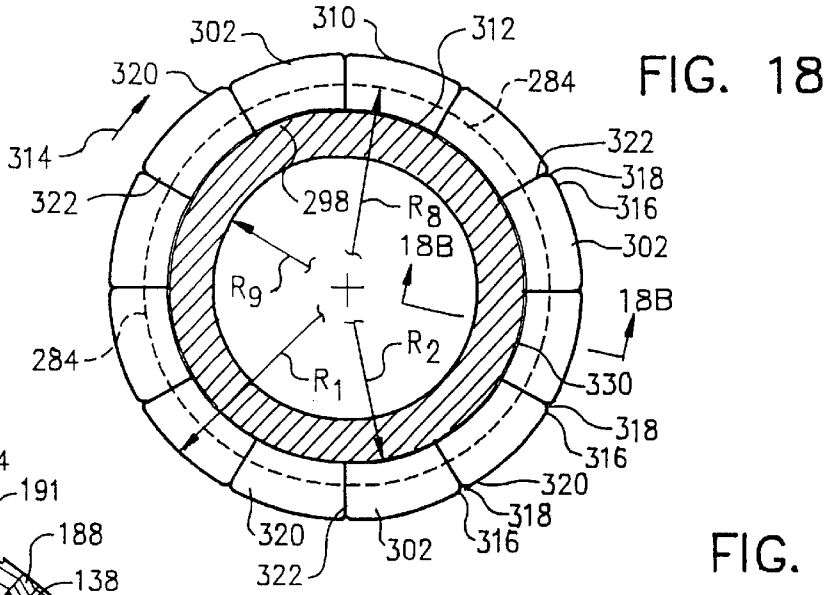

FIG. 18 is a transverse cross-sectional view of our novel disc cutter design with a hard metal segmented cutting edge, using twelve hard metal inserts.

Figure 18A:
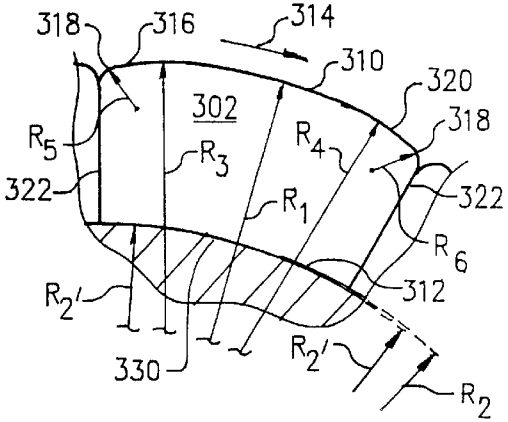

FIG. 18A is an enlarged transverse cross-sectional view of a hard metal segment as used in one embodiment of our novel disc cutter, showing three critical radii which when properly sized will achieve desired reliability of hard metal segment inserts.

Figure 18B:
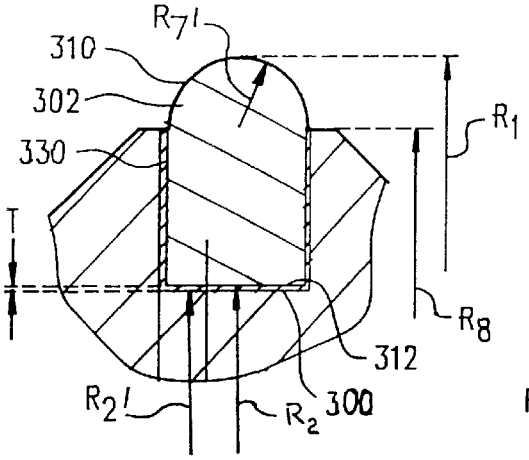

FIG. 18B is an axial cross-sectional view, taken along the rolling axis, of a hard metal insert segment as used in one embodiment of our novel disc cutter, illustrating one critical radius which when properly shaped will achieve desired minimum lateral forces necessary to achieve the desired reliability of of the disc cutters.

Figure 18C:
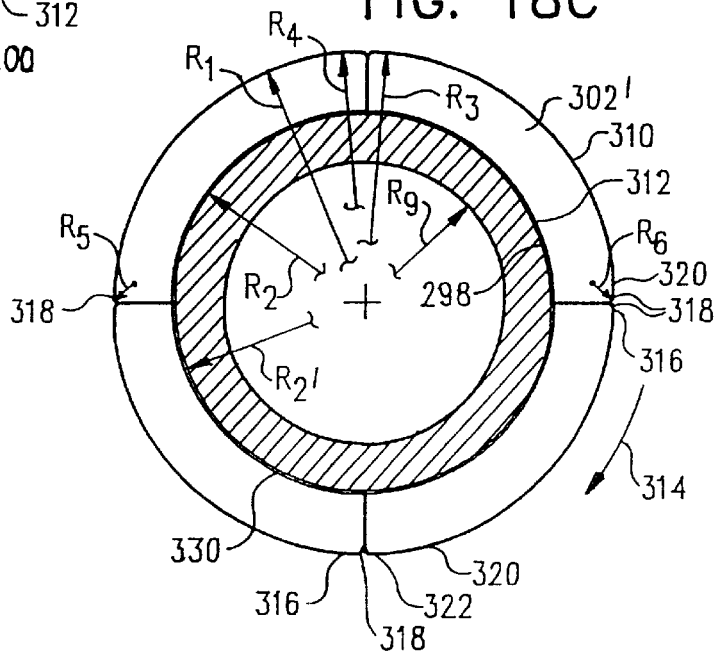

FIG. 18C is a transverse cross-sectional view of our novel disc cutter design with a second embodiment of our hard metal segmented cutting edge design, utilizing four hard metal segments.

Alternate Embodiments

Figure 19A:
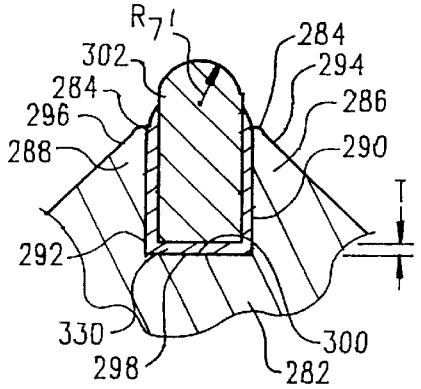
Figure 19:
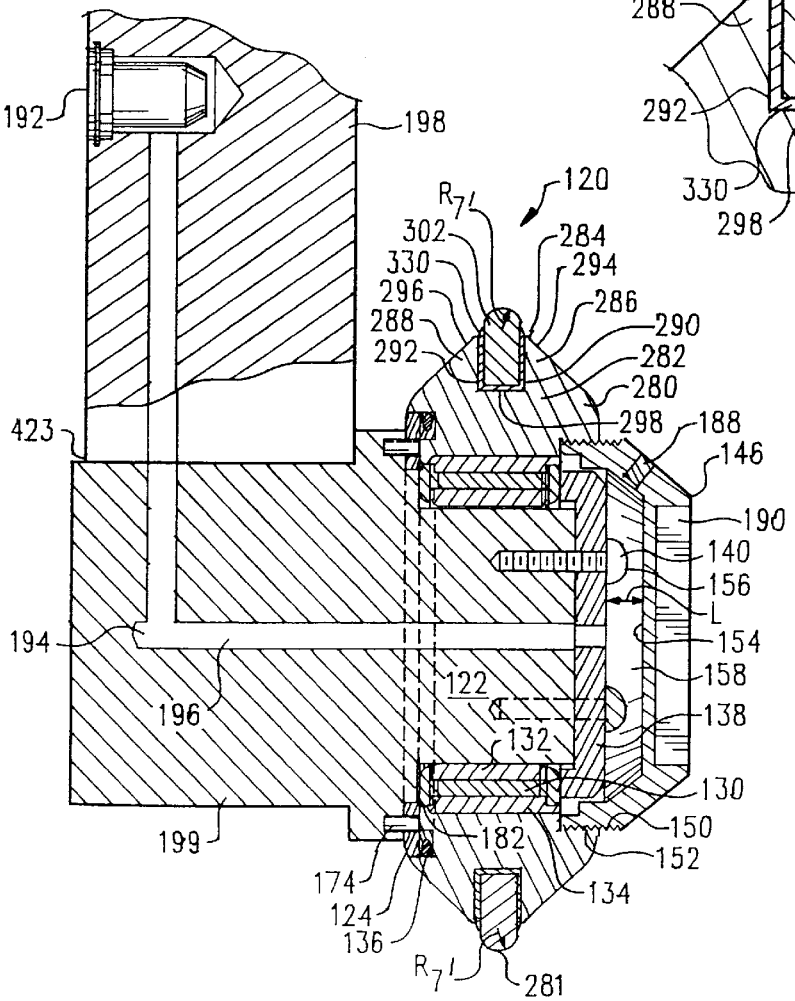

FIG. 19 is an axial cross-sectional view of a second embodiment of our novel fully assembled disc cutter, shown utilizing a hard metal insert cutting edge.

FIG. 19A is a partial axial cross-sectional view of the disc cutter ring first shown in FIG. 19, now illustrating the technique used for brazing the hard metal inserts to the cutter ring.

Figure 20:
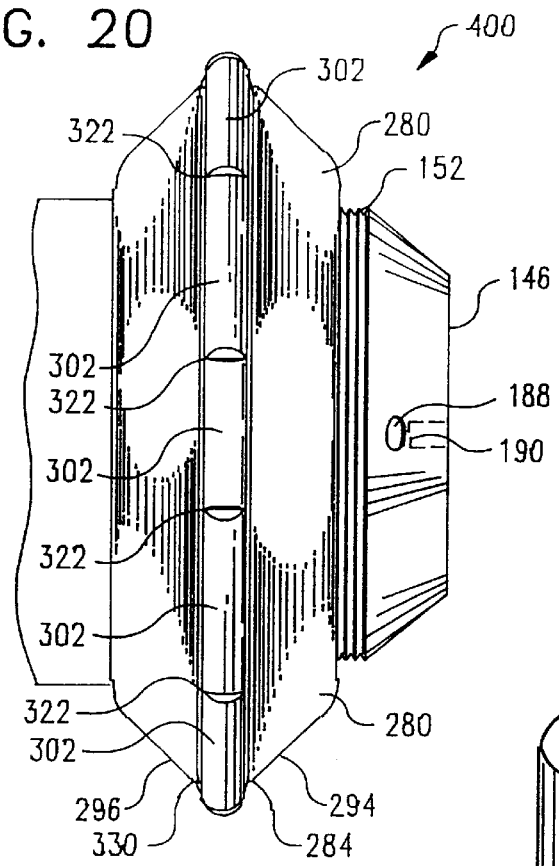

FIG. 20 is a top view, looking downward on a disc cutter ring as set forth in FIG. 19, showing a twelve segment hard metal insert design in its operating configuration.

Cutterheads (And Their Details)

Figure 21:
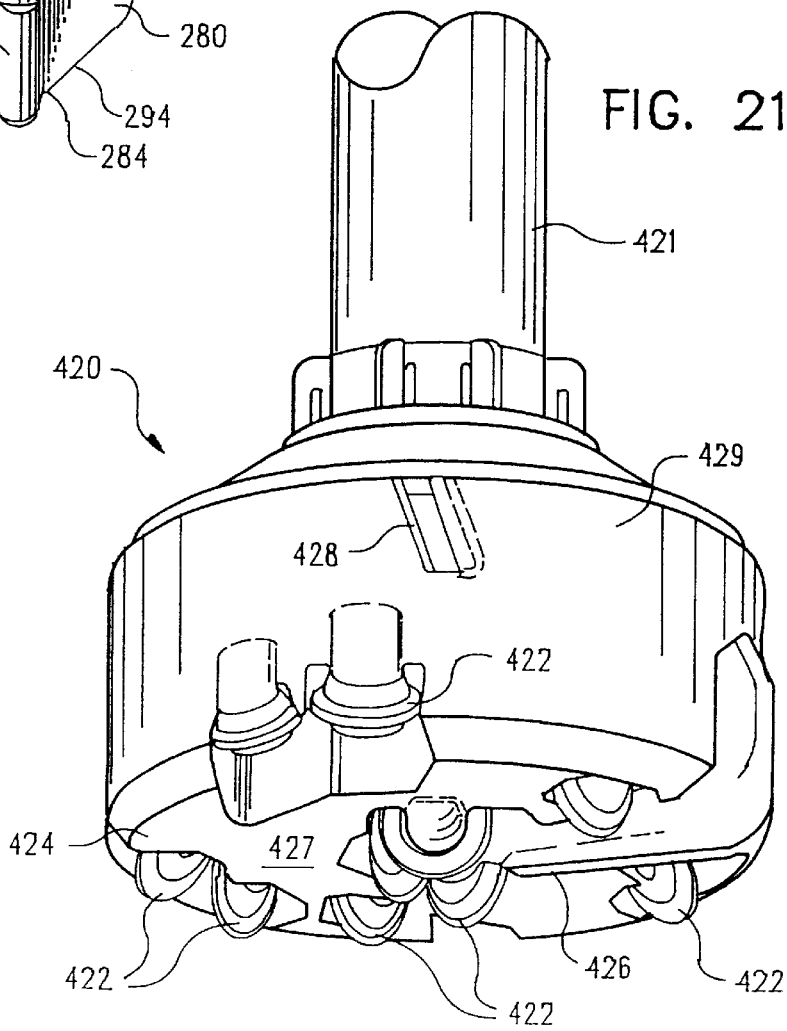

FIG. 21 is a side perspective view, looking slightly oblique to the face of a cutterhead designed using the novel disc cutters disclosed herein.

Figure 22:
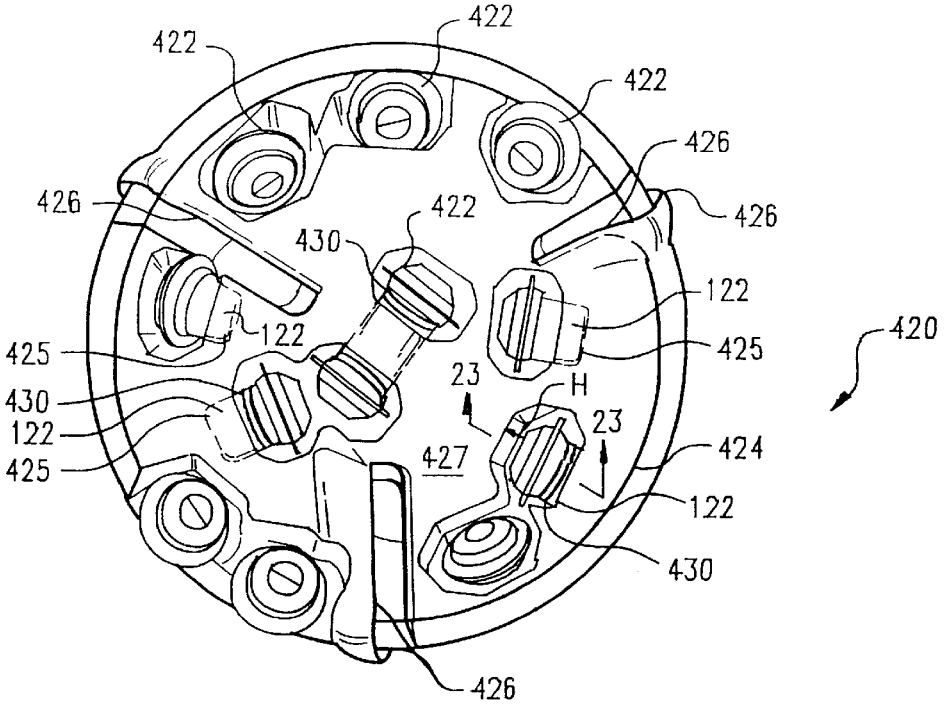

FIG. 22 is a front view, looking directly at the cutterhead design first illustrated in FIG. 21.

Figure 23:
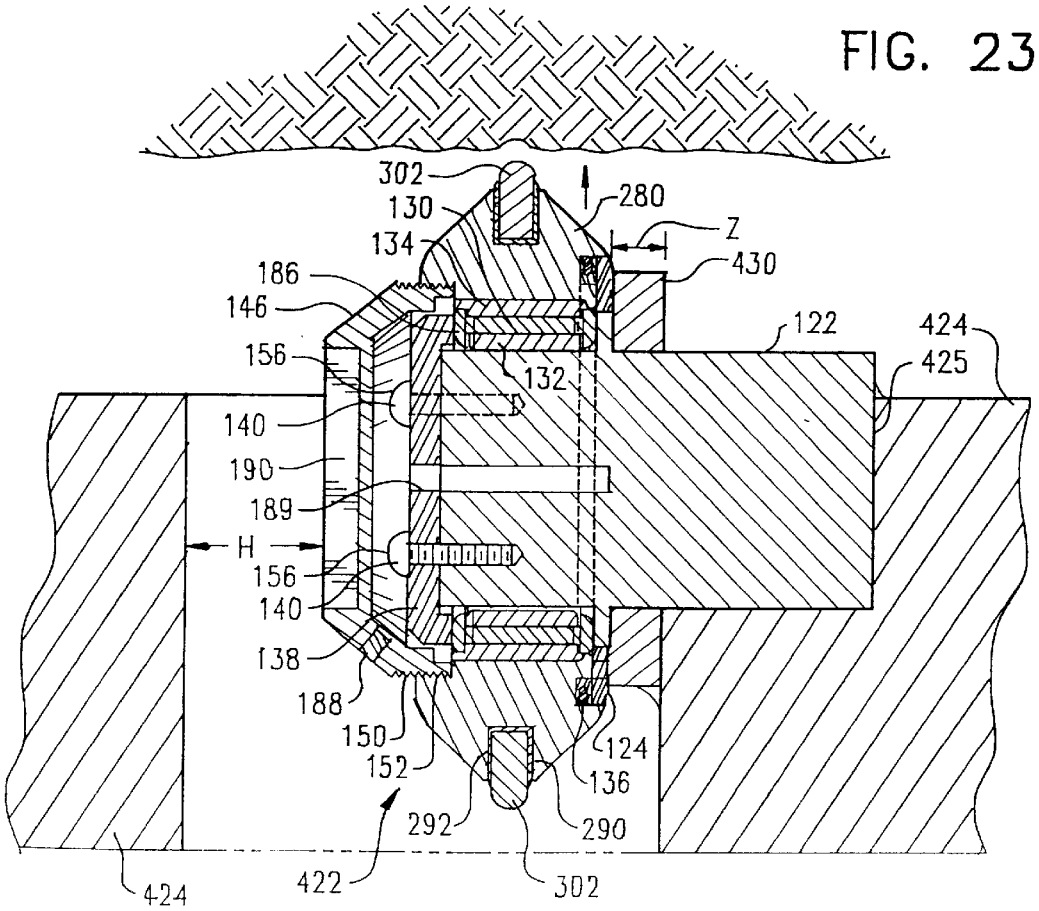

FIG. 23 is a vertical cross-sectional view, taken through section 23—23 of FIG. 22, illustrating the cantilever mounting technique for employing the novel disc cutter of the present invention in a cutterhead.

Figure 24:
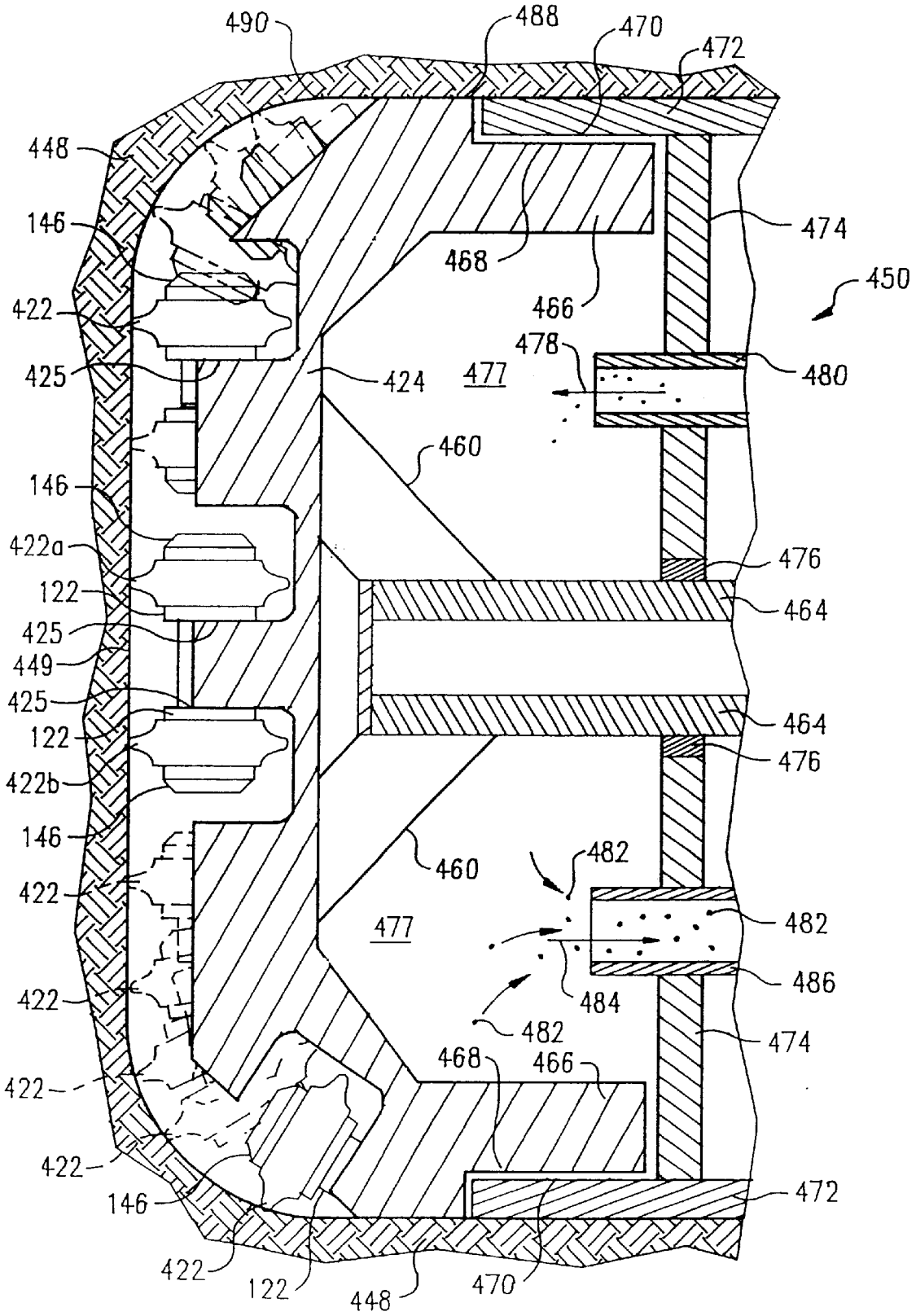

FIG. 24 is a cross-sectional view of one embodiment of the cutterhead first set forth in FIG. 21 above, illustrating use of a central drive shaft with drilling fluid (slurry) muck removal.

Figure 25:
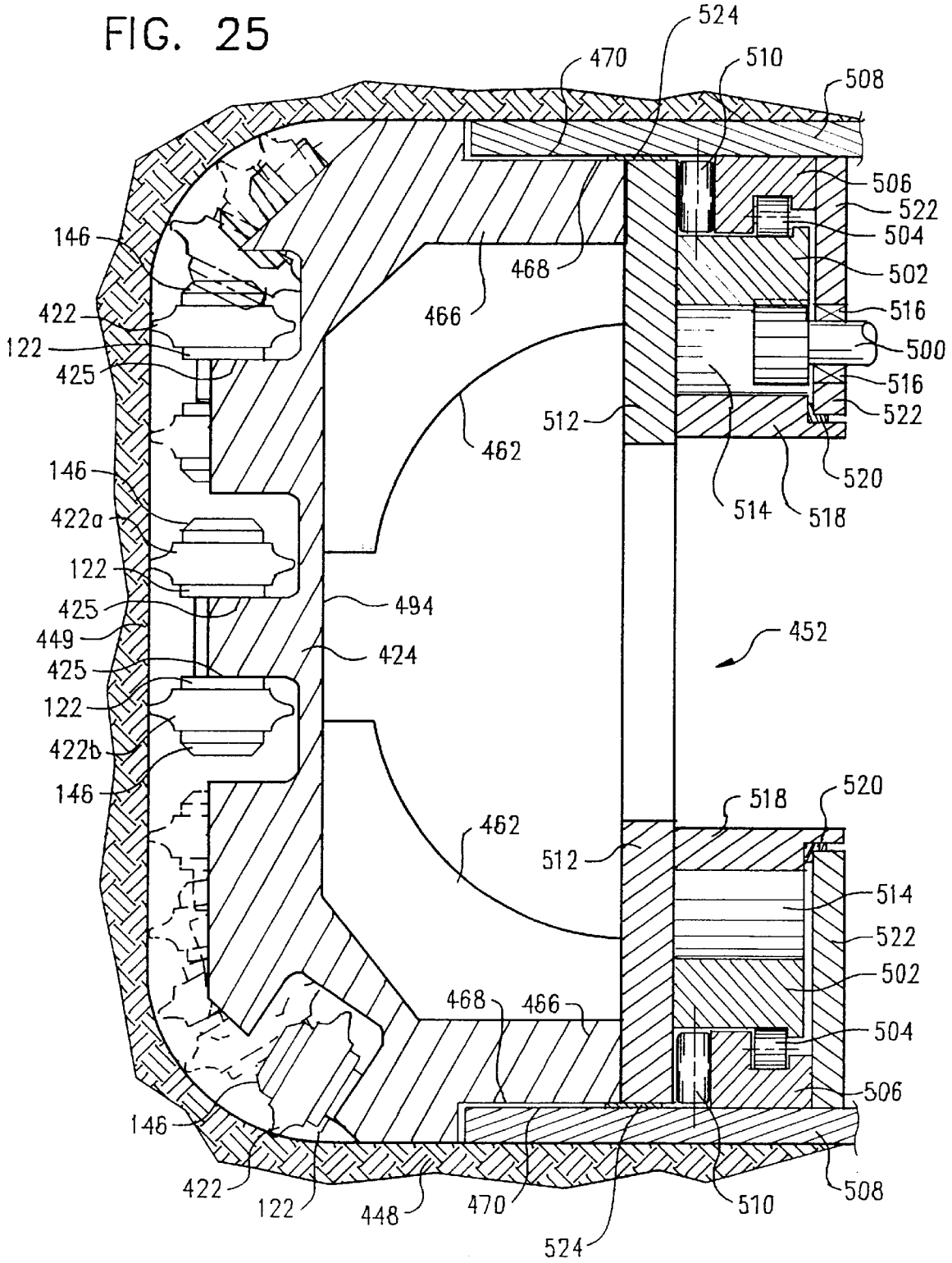

FIG. 25 is a cross-sectional view of a second embodiment of a cutterhead using the novel disc cutter disclosed herein.

Figure 26:
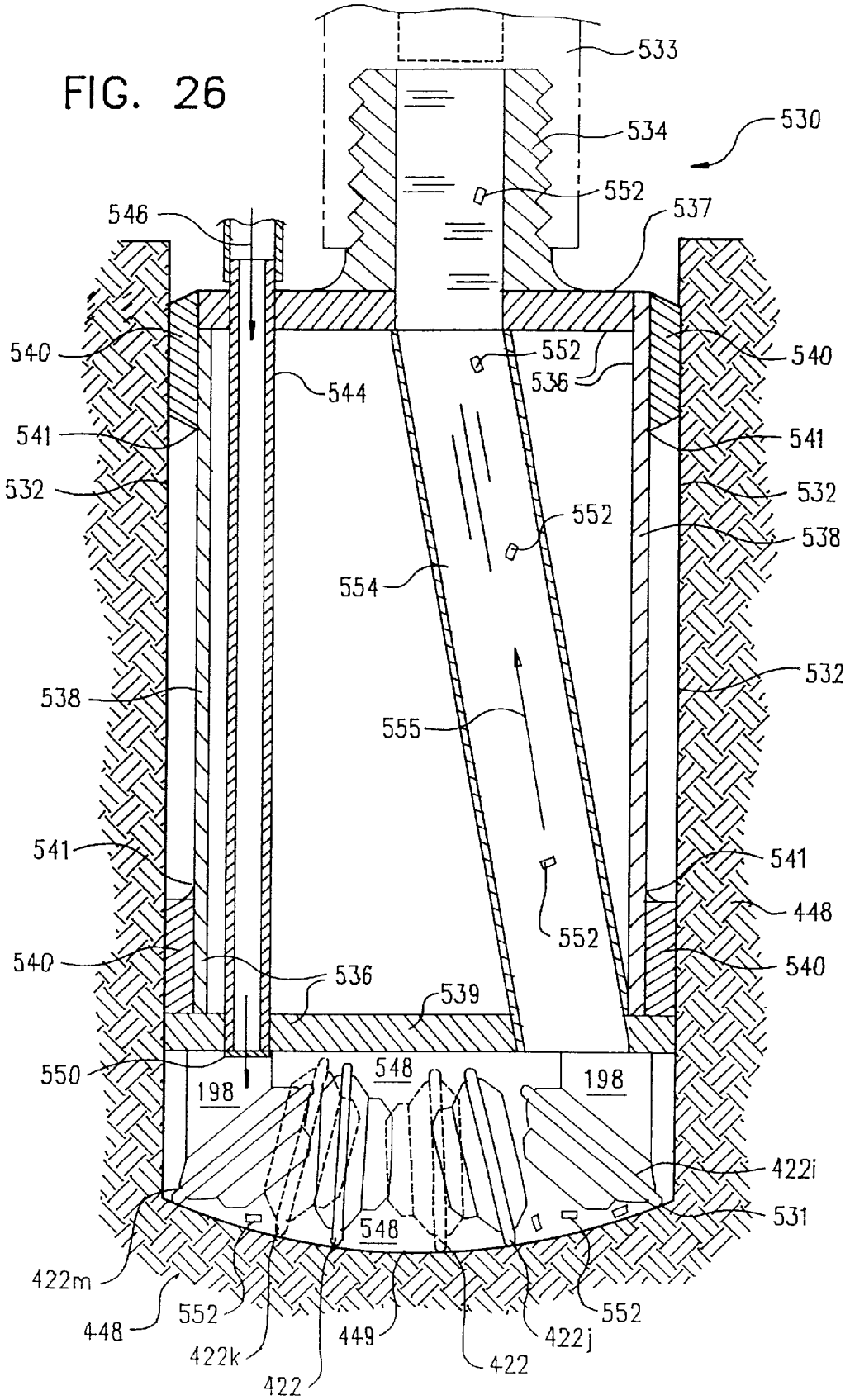

FIG. 26 is an axial cross-sectional view of a blind drilling cutterbody, employing the novel disc cutters disclosed herein.

Core Drill Bit

Figure 27:
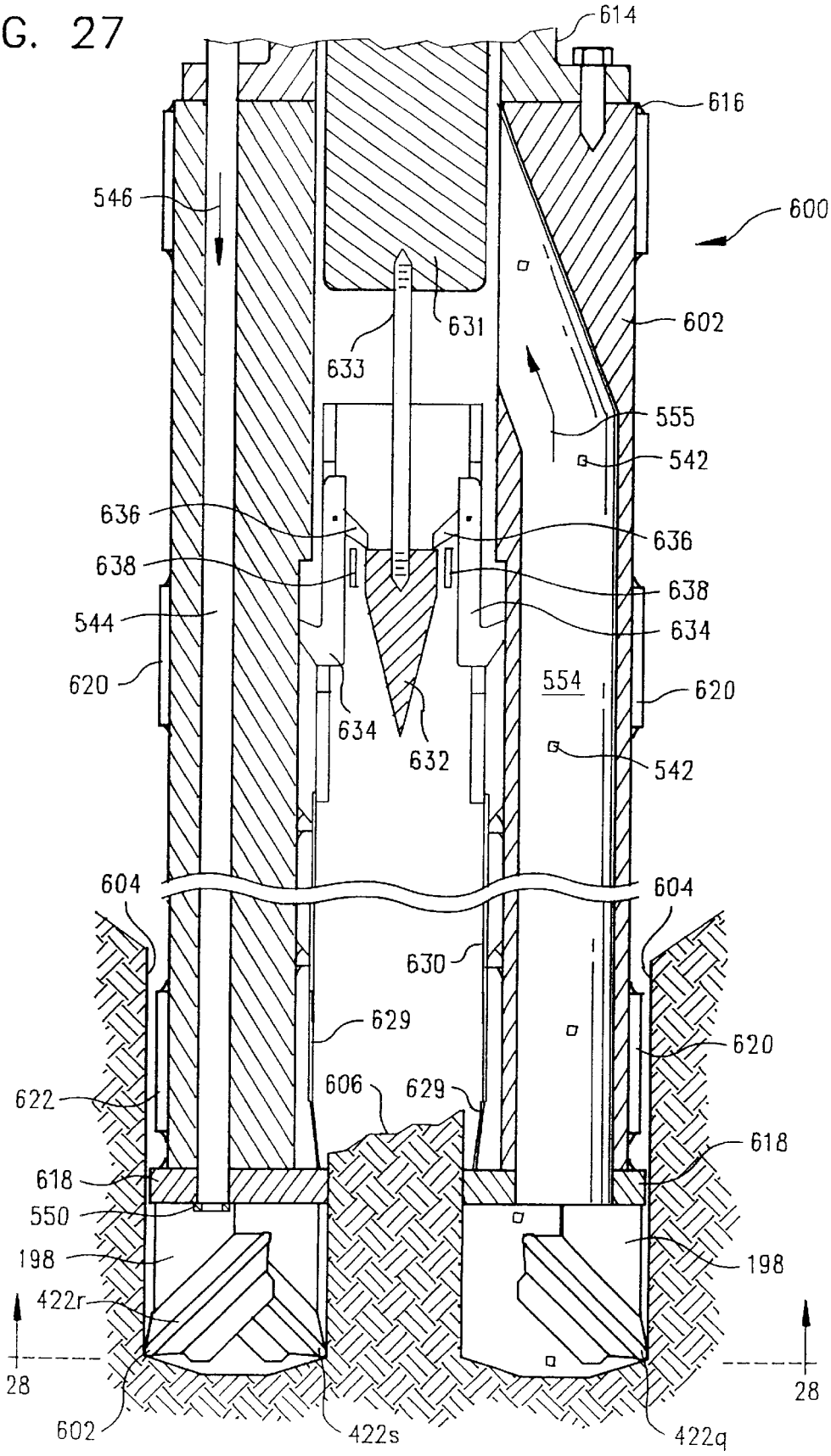

FIG. 27 is a vertical cross sectional view of a core drilling bit employing the novel disc cutters as described herein.

Figure 28:
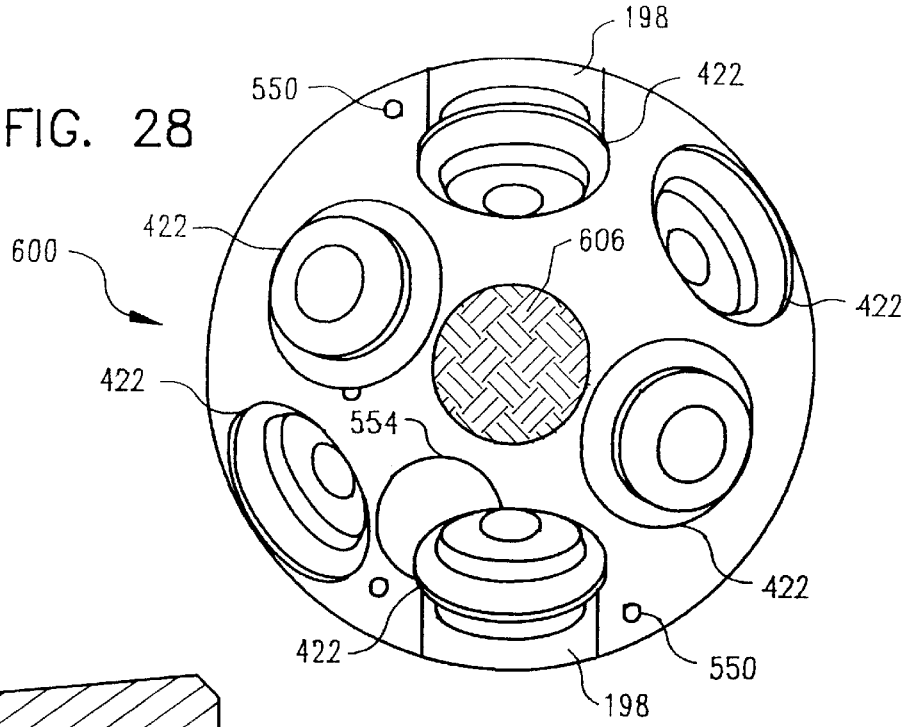

FIG. 28 is a bottom view, looking upward at the cutting face of the core drilling bit first illustrated in FIG. 27 above.

Alternate Bearing Arrangements

Figure 29:
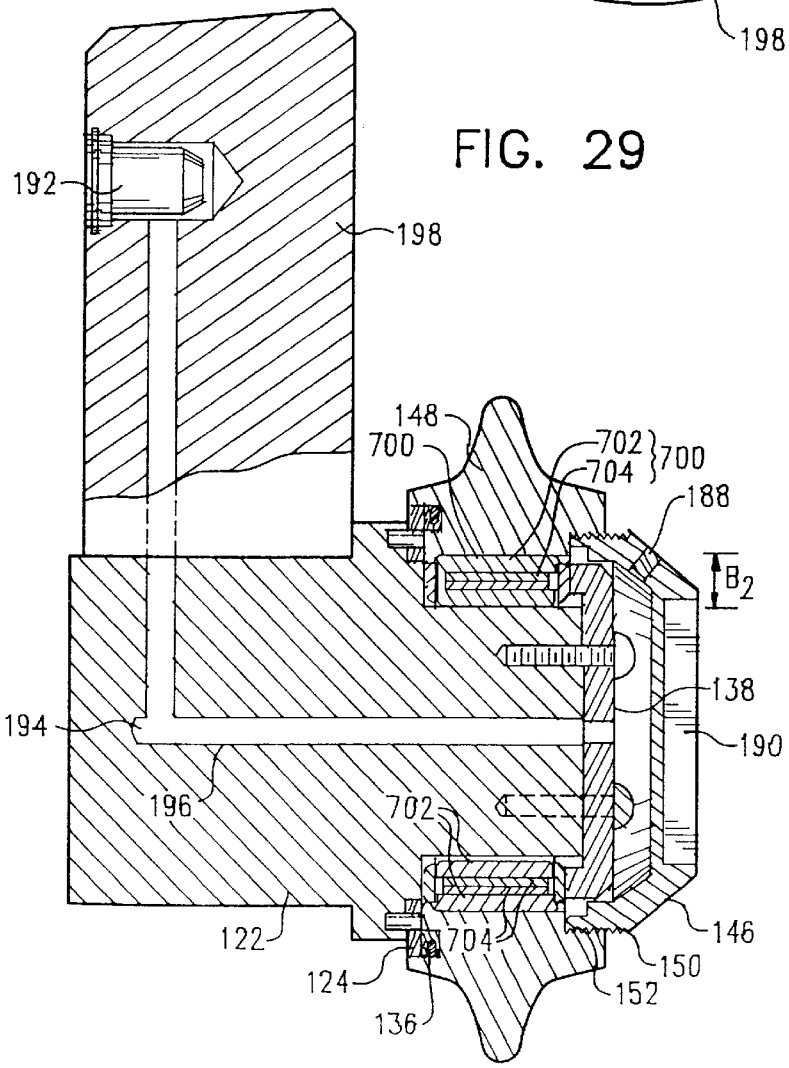

FIG. 29 is a vertical cross-sectional view of the disc cutter of the present invention, showing another embodiment utilizing a journal type bearing.

Figure 30:
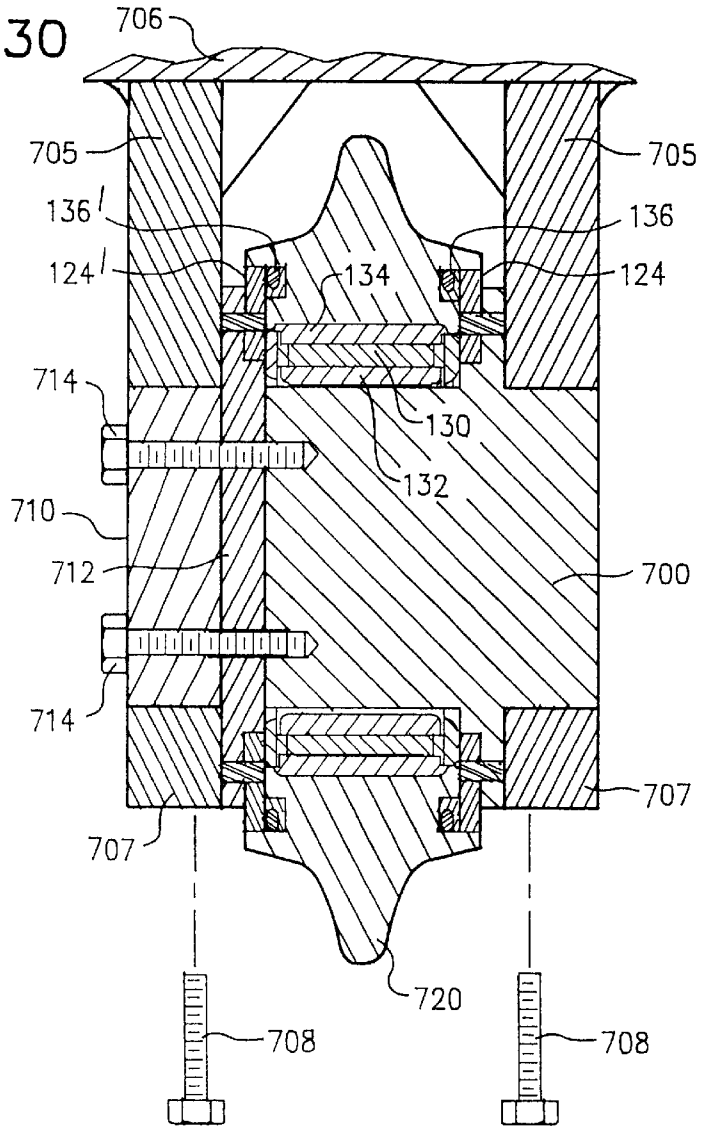

FIG. 30 is a vertical cross-sectional view of the disc cutter of the present invention, showing our novel disc cutter being utilized in a saddle mounted shaft type application.

Figure 31:
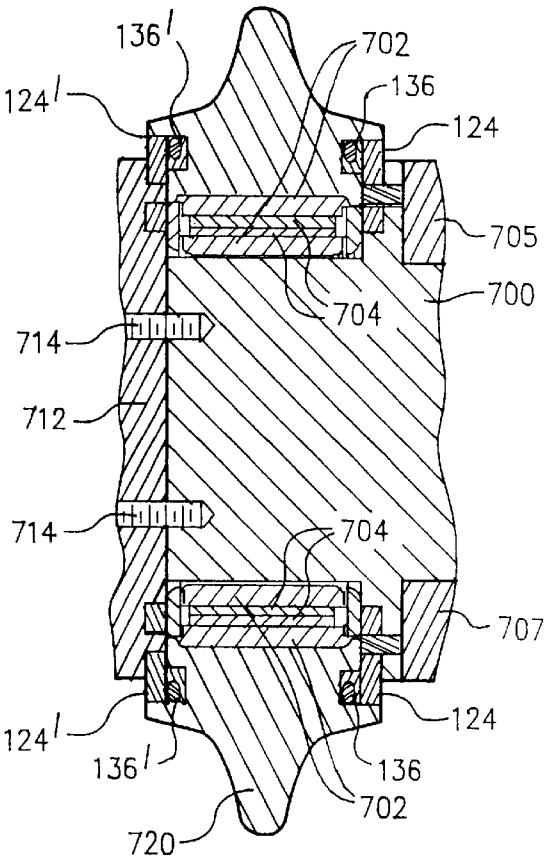

FIG. 31 is a vertical cross-sectional view of the novel disc cutter disclosed herein, showing a saddle mounted shaft type application, and employing journal bearings.

In order to minimize repetitive description, throughout the various figures, like parts are given like reference numerals.

Theory

The fundamental operational principles involved in using a disc cutter for rock excavation are well known by those familiar with the art to which this specification is addressed. However, a review of such principles will enable the reader, regardless of whether skilled in or new to the art, to appreciate the dramatic improvement in the state of the art which is provided by our novel disc cutter design, and novel cutterheads which use our disc cutter design, as disclosed and claimed herein.

Figure 1:
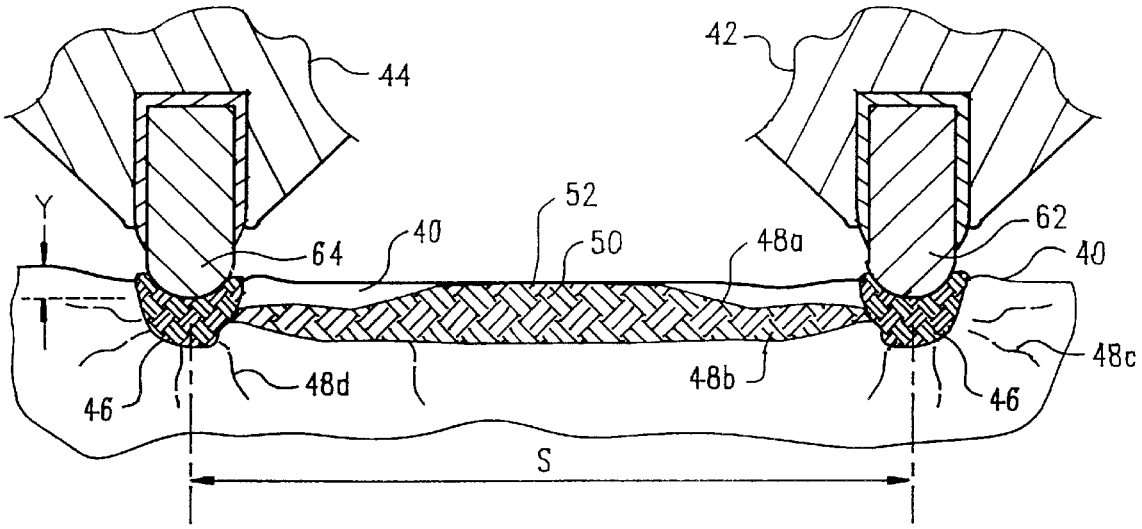
FIG. 1 is generalized vertical cross-sectional view illustrating the principles of rock cutting by use of rolling type disc cutters, showing in partial cross-section the exemplary disc cutter of the present invention.

Attention is directed to FIG. 1, which shows a hard rock 40 being cut by disc type cutters 42 and 44. Although the cutters 42 and 44 are shown in this FIG. 1 in the design of the novel disc cutters described and claimed herein, the general principles of disc cutter operation are the same as with various heretofore known disc cutter devices; those prior art devices will in due course be distinguished from the exemplary novel cutters 42 and 44. By applying pressure downward from adjacent cutters 42 and 44 toward rock 40, a zone 46 of rock directly beneath each disc cutter is crushed. The force required to form the crush zone 46 is a function of both cutter geometry and characteristics of the rock, particularly the compressive strength of the rock. Zones 46 provide a pressure bulb of fine rock powder which exerts a downward and outwardly extending hydraulic-like pressure into the rock 40. This pressure causes cracks 48*a*, 48*b*, 48*c*, 48*d*, etc., to form in the rock 40. When the cracks 48*a* and 48*b* contact each other, a rock chip 50 spalls off the surface 52 of the rock 40. The objective of efficient rock cutting is to crush a minimum of rock 46 and spall off chips 50 which are as large as possible, thus maximizing the volume of rock chips 50 produced by the chipping action.

Figure 2:
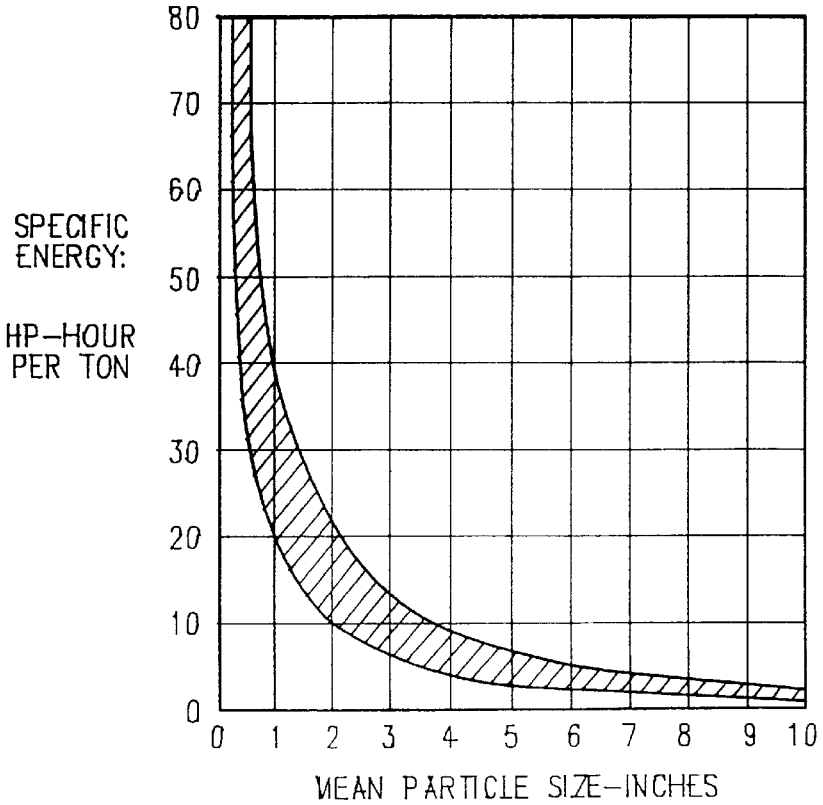
FIG. 2 is a graphic illustration of the relationship between specific energy required for excavation and mean particle size.

To form the maximum volume of large chips 50, the lateral spacing S between the kerf or path 52*a* and 52*b* of adjacent cutters (see FIG. 3) such as cutters 42 and 44 in FIG. 1, should be maximized. In that way, a minimum amount of crushing of rock 40 in zones 46 takes place, and a maximum size chip 50 is produced. Generally, this concept may be expressed as a relationship between mean particle size and the specific energy required for the rock 40 being excavated. One customary unit of measure in which the specific energy requirement is often expressed is in terms of horsepower-hour required per ton of rock excavated. FIG. 2 graphically expresses this relationship between mean particle size (i.e., rock chip 50 size) and the specific energy required. As is evident from FIG. 2, it would be advantageous to increase the mean particle size, or rock chip size 50, in order to reduce the amount of energy required to excavate in a given rock 40. FIG. 2 also reveals that if a present method of excavation produces particles (chips) of small average size, performance (rock output per unit of time) can be greatly enhanced (as much as 10 times) at the same horsepower input by substantially increasing the mean particle size. As described herein below, our novel disc cutter design is able to achieve such an increase in mean particle size in certain applications, which is quite extraordinary, for example, when compared to use of certain roller cone type cutters presently used in drilling.

Figure 3:
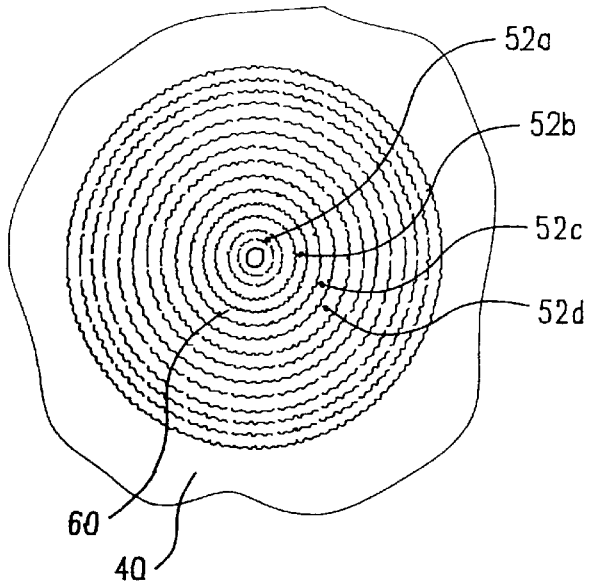
FIG. 3 is a rock face view showing the pattern left in a rock face when an excavating device using rolling type disc cutters is employed.

As illustrated in FIG. 3, when drilling in rock a rock 40, a concentric circle pattern is typically created when single rolling disc cutters such as cutters 42 and 44 are acting on the face 60 of the rock 40. Chips 50 tend to be proportional to the distance S between concentric paths or kerfs 52*a*, 52*b*, 52*c*, 52*d*, etc. which are cut by the disc cutters such as cutters 42 and 44. It is most efficient to run only one disc cutter in a path or kerf 52*a*, 52*b*, 52*c*, etc. (single tracking). In summary, a series of properly spaced disc cutters, cutting repeatedly in the same parallel or concentric kerf 52*a*, or 52*b*, or 52*c*, etc. (to take advantage of previously formed cracks) is the most efficient mechanical technique for cutting rock heretofore known. Our invention improves upon this technique.

Figure 4:
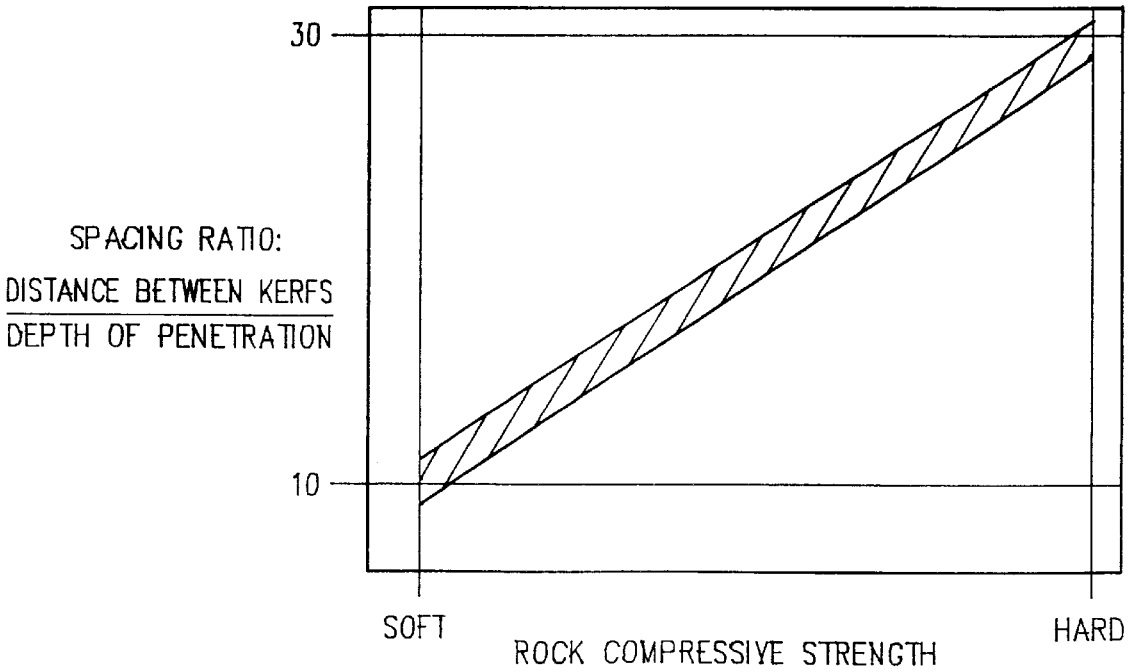
FIG. 4 is a graphic illustration of the relationship between spacing ratio of rolling disc cutters and the compressive strength of the rock being excavated.

Directing attention again to FIG. 1, when cutter 42 or 44 is cutting rock 40, the cutters 42 and 44 penetrate into rock 40 by a depth Y. A relationship exists between the depth of penetration Y into the rock 40 and the the spacing or width S between blades of cutters 62 and 64 of cutters 42 and 44, as shown in FIG. 4. This relationship is simply expressed as a spacing ratio, i.e., the distance between kerfs (e.g. the distance between kerf 52*a* and 52*b*) divided by the depth of penetration Y. Generally speaking, in order to increase spacing S, and thus to improve rock cutting efficiency (in terms of specific energy), a cutter must be thrust deeper (larger penetration Y) into the rock 40. Without regard to the specific type of rolling disc cutter being used, in general, the spacing ratio will be lower in softer or more elastic rock, and can be increased in harder, more brittle rock.

Figure 5:
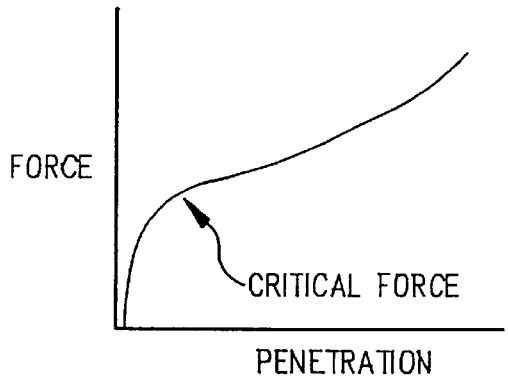
FIG. 5 is generalized graphic illustration of the relationship between the thrust force and the rock penetration achieved in excavation, and illustrating the critical force required to achieve rock excavation.

Parameters which affect penetration Y are (1) characteristics of the rock being cut, (2) thrust of the cutter blade against the rock, (3) the diameter of a selected cutter, and (4) blade width of the cutter. The latter two parameters, taken together, are frequently referred to as the cutter "footprint." Any given cutter configuration, on any given rock, must achieve a "threshold" pressure to produce a "critical force" beneath that cutter for that specific rock type before significant indentation (penetration in the Y direction) of the rock will occur; this relationship is presented in FIG. 5. As thrust is initially increased, minimal penetration Y occurs. At thrust forces above the "critical force", penetration Y varies as a proportional function of the thrust force.

The critical force is a function of rock characteristics (primarily hardness, toughness, porosity, crystalline structure and microfractures) and of disc cutter blade geometry (primarily cutter diameter, blade shape and blade width). On hard rocks, with the disc type cutters known heretofore, the critical force can easily be 50,000 lbs. or more, depending upon the cutter configuration and rock characteristics.

The Prior Art

As discussed above, it is generally known in the art that a relationship exists between penetration Y and spacing S, and between increased spacing S and the production of larger rock chips, and that production of larger chips will normally result in increased efficiency (i.e., lower specific energy). The method which has heretofore been employed by others in the art to exploit this relationship has been to use larger and larger diameter disc cutters. Such large diameter cutter designs have been adapted to accommodate high thrust forces by provision of larger and larger bearings. Such bearings have been used to allow rotation of the cutter at the increased thrust force on the rock which is necessary in order to achieve deeper penetration Y.

In so far as we are aware, tunnel boring machine ("TBM") manufacturers have heretofore generally employed a disc cutter configuration similar to that shown in FIG. 6. Such disc cutters 70 are now most commonly produced and sold with a diameter D of seventeen (17), eighteen and one-quarter (18.25), nineteen (19), and twenty (20) inches. Also, such cutters 70 have been saddle mounted, that is the shaft 72 is supported at both ends (74 and 76). This has been structurally desirable, to avoid deflection, and generally necessary in order to withstand the high thrusts required for rock penetration. Blade (cutter tip or rim) 78 widths W of 0.5 inch to 0.8 inch are most common. The largest cutters of which we are aware have a claimed thrust capacity of up to 75,000 pounds force. That is, by way of the forces imposed on the cutterhead, and through the cutter shaft 72, and supported by a saddle type mount (not shown) on both ends 74 and 76 of the shaft 72, the cutter blade or ring 78 can in turn exert 75,000 lbs force normal to a rock face.

Although conventional disc cutter technology has thus increased the depth of cut (penetration Y) by increasing thrust capacity of the cutter, the desired increased thrust capacity has been achieved by resorting to larger and larger diameter disc cutters. This trend by others has resulted in their use of a series of large bearings, normally of the double tapered roller type 80, which in turn require large diameter cutter rings 78 to allow space within the cutter 70 to accommodate the large bearing 80 mechanisms. For example, in a cutter 70 of seventeen (17) inches diameter D, bearing space $B_1$ required on each side of shaft 72 may together ($B_1$+$B_1$) range up to thirty five percent (35%) or more of the total diameter D. Thus, a high percentage of the total radial space in the design is used up as bearing space $B_1$. The relatively small shaft diameter A resultingly leaves the radial space occupied by the shaft 72 (or axle) insufficiently large for use in cantilever mounting of the prior art cutters 70. Therefore, such prior art cutters have normally had a shaft which is supported at both ends, or "saddle mounted."

These large size, heavy weight cutters such as cutter 70, and their accompanying saddle type shaft mounts, make modern single row, rotating disc cutters useable only in conjunction with large diameter cutterheads. Due to the size and weight of the prior art large diameter disc cutter designs, it is not practical (or even possible, in many cases) to use such disc cutters in smaller diameter cutterheads, much less in drilling bits. As a result, in so far as we are aware, rotating disc cutters have not generally been used, if used at all, in such applications.

Also, as can be appreciated from the study of the prior art cutter 70 illustrated in FIG. 6, the assembly and disassembly of such prior art cutters is complex. The cutter 70 contains over twenty (20) parts. In the most common size (seventeen (17) inches diameter) such cutters 70 are quite heavy, usually in the 350 lb. range. Major parts of prior art cutter 70 include the inner bearing races 82 and 82', tapered bearings 80 and 80', outer bearing races 86 and 86', a hub 88 with a radial flange or rib 92 on the outer shoulder 94, and a retainer ring 96. When cutters such as cutter 70 require maintenance, such as replacement of the blade or cutter ring 78 or replacement of the bearings 80 or 80', the entire cutter assembly 70 (as shown) is removed from a boring machine and carried away from the point of excavation. Generally cutters 70 are too heavy for manual removal and carriage by workmen, and therefore must be removed with the help of lifting equipment and transported by conveyance to a cutter repair shop outside of the tunnel or excavation site, in order to be repaired or rebuilt. There, using special tools, the cutter ring 78 and possibly seals 98, 100, 102, and 104, as well as bearings 80 and 80' and their respective races when necessary (inner races 82 and 82', and outer races 86 and 86'), are replaced and the cutter assembly 70 is returned to the excavating machine. Such prior art large disc type cutters are described in various patents; U.S. Pat. No. 4,784,438, issued Nov. 15, 1988 to Tyman Fikse for TUNNELING MACHINE ROTATABLE MEMBER, is representative.

Various attempts have also been made to improve the design of disc type cutters. One attempt which superficially resembles one embodiment of our improved cutter disc is described in U.S. Pat. No. 3,791,465, issued Feb. 12, 1974 to Metge for BORING TOOL. That patent describes the use of carbide or nitride plates inserted at the outer periphery of a cutter wheel to provide a continuous cutting edge, rather than using buttons. However, although Metge tries to reduce the shock applied to a hard metal insert by using a continuous edge rather than spaced buttons to impact the rock face, he does not address the precise shape of such plates which we have found necessary in order to provide a reliable and long life set of cutter blade inserts. Nor does Metge utilize an inserted segment to provide a self sharpening cutter ring as we will describe hereinbelow. Finally, Metge does not address the problem of differential thermal expansion between the hard metal inserts and the cutter blade steel, a quite serious matter which we have solved.

Other types of drilling applications are also of interest, since in addition to use of our novel disc cutter design in boring or excavating equipment as already described, our disc cutter may be advantageously applied in relatively small diameter drilling applications. Heretofore, for example, tri-cone type drill bits have been commonly used in drilling holes up to about twenty three (23) inches in diameter. Bits of that type commonly employ carbide button inserts, either in multi-row or randomly close spaced patterns. Drilling using such prior art tri-cone bits typically results in production of rock material ranging in particle size from powder to a coarse granular sand. The specific energy expended in using such tri-cone bits is in the range of approximately 80 horsepower-hours per ton (HP-hr/ton) and upward for excavation. However, by use of our disc cutter design in cutterheads in this size range, the specific energy required for such drilling operations can be dramatically reduced.

In summary, insofar as we are aware, no bearing and structural support configurations have heretofore been provided or suggested (1) for small diameter disc cutters (i.e. preferably in the range of about fourteen (14) inches diameter and smaller, and more preferably in the range of about ten (10) inches diameter or smaller, and most preferably in the five (5) inch diameter range or smaller) with the structural capability to reliably endure the high thrusts required to meet and exceed the critical pressure required for rock excavation, or (2) are of a size which can advantageously applied to small diameter cutterheads.

Summary

The present invention relates to an improved rolling type disc cutter and to a method for mounting the cutter in a cutterhead assembly. Our novel disc cutter and cutterhead designs provide:

improved disc cutter geometries;

high footprint pressure;

improved hard metal insert configurations;

improved disc cutter bearing designs;

more robust structural supports for the cutter;

simplified cutter mounting apparatus and methods;

small diameter cutterheads with disc cutters; and improved cutter rebuilding methods.

In addition, the disc cutter of the present invention provides higher penetration into any given rock at lower thrust than conventional disc cutters. This performance factor at lower thrust is very significant in many types of excavating machinery design. The lower thrust requirements possible by use of our designs allow lighter excavating machine structural components, as well as lower operating power requirements for a given excavation task. Moreover, this combination makes feasible the design of significantly more mobile excavating equipment.

In practice, it is in smaller diameter cutterheads (in drilling, the entire cutterhead is sometimes referred to as a bit) that some of the most dramatic increases in performance may be achieved by the present invention. For example, in small diameter cutterheads or bits, by using our disc cutter and cutterhead design, the specific energy required for drilling can be reduced by about an order of magnitude, for example, from about 80 HP-hr/ton to about 8 HP-hr/ton. Also, our disc cutter and cutterhead, by providing larger average chips, can achieve an excavation rate (lineal feet per hour) which is improved by about a factor of ten (10) over drill bits known heretofore.

We have developed a novel rolling disc cutter for use in a mechanical excavation apparatus to exert pressure against substantially solid matter such as rock, compacted earth, or mixtures thereof by acting on the rock or earth face. The cutter is of the type which upon rolling forms a kerf by penetration into the face so that, by using two or more cutters, solid matter between a proximate pair of said kerfs is fractured to produce chips which separate from the face. The disc cutter components include a relatively stiff shaft defining an axis for rotation thereabout, a proximal end for attachment to the excavation apparatus, and a distal end at or near which a cutter ring is rotatably attached. A cutter ring assembly, is provided, wherein the cutter ring assembly further includes an annular cutter ring having an interior annulus defining portion and an outer ring portion. The outer ring portion includes a cutting edge having diameter OD and radius $R_1$. The cutter ring assembly further includes a bearing assembly, which is shaped and sized (i) to substantially fit into the annulus defined by the cutter ring, and (2)in a close fitting relationship with the shaft, so that the cutter ring may rotate with respect to, and be supported by said shaft, with minimal deflection of the shaft. The bearing assembly includes a bearing, and a seal. The seal is adapted to fit sealingly between the cutter ring and an external hard and polished washer surface, provided integrally with the shaft or optionally provided by a hard washer ring. The seal provides a lubricant retaining and contamination excluding barrier between the cutter ring and the shaft or shaft support structure. A retainer assembly, which includes a retainer plate and fasteners to affix the retainer plate to the shaft, is provided to retain the cutter ring assembly on to the shaft. A hub cap is sealing affixed to the cutter ring, in order to seal the interior annular portion of the cutter ring assembly, so that, in cooperation with the seal and the cutter ring, a lubricant retaining chamber is provided.

In one embodiment, the cutter ring further includes a pair of laterally spaced apart support ridges, wherein the ridges have therebetween a groove forming portion, with the groove forming portion including a pair of interior walls, and an interior bottom surface interconnecting with the interior walls. The interior walls outwardly extend relative to the interior bottom surface to thereby define a peripheral groove around the outer edge of the outer cutter ring. Two or more, or as many as twelve or more hardened, wear-resistant and preferably hard metal inserts are substantially aligned within and located in a radially outward relationship from the groove. The inserts further include a (i) substantially continuous engaging contact portion of radius $R_1$, wherein the contact portion on the outer side of said inserts are adapted to act on said face, (ii) a lower groove insert portion, which has a bottom surface shaped and sized in complementary matching relationship relative to said bottom surface of said groove, and first and second opposing exterior side surfaces which are shaped and sized in a complementary matching relationship relative to the interior walls, (iii) a rotationwise front and rear portion. The lower groove insert portion of the inserts fit within the groove in a close fitting relationship which defines a slight gap between the inserts and the interior walls. A somewhat elastic preselected filler material such as a braze alloy is placed between and joins the inserts in a spaced apart relationship to the groove bottom and to the interior sidewalls. The preselected filler material is chosen so that it has a modulus of elasticity so that in response to forces experienced during drilling against a face, the inserts can slightly move elastically relative to the cutter ring so as to tend to relieve stress and strain acting on the insert segments.

Objects, Advantages, and Novel Features

The present invention has as its objective the provision of an improved disc cutter design which improves cutting rates at lower thrust pressures.

It is therefore an important feature of this invention that the disc cutter and cutter head design provide a mechanical excavation method which reduces the required thrust against the rock surface being attacked.

It also an important object of this invention to provide a simplified cutter head design which reduces the cost of operating and maintaining rolling disc cutters.

It is therefore a feature of our disc cutter invention that the weight and complexity of the disc cutter is significantly reduced.

Another important object of our invention is to meet or exceed the performance of prior art large, heavy, 17 inch or larger disc cutters with a small, light-weight disc cutter.

It is accordingly an important feature of our invention that the disc cutter may be completely assembled and disassembled with common hand tools by a single workman, without resort to heavy lifting equipment.

It is a still further object of this invention to achieve a high rock pressure capability on a small diameter disc cutter so that disc cutter technology may be extended to small diameter cutterheads and to drill bit bodies.

A further objective of this invention is to achieve a robust cantilever mounting method which permits close kerf (concentric cutter tracks) spacing, in order to accommodate use on small cutterheads.

A related objective is to achieve the ability to closely space disc cutters without resort to multiple row cutter placement.

It is a further objective of this invention to provide a recessed cutter type mount which may be directly welded into the cutterhead structure, thus avoiding the necessity to use saddle or two sided type disc cutter mounting.

It a a related objective of this invention to provide use of recessed disc cutter mounting methods for manufacture of a shielded type cutterhead that is suitable for use in broken rock or in soft ground with boulders.

A still further objective of this invention is to provide a cutterhead which quickly scoops up the rock cuttings, bringing them inside the head as they are created, thus eliminating inefficient regrinding of the cuttings.

Yet a further object of this invention is to provide a disc cutter which is easier to install and maintain than previously used disc cutters.

A still further object is to provide a disc cutter design which reduces the lateral thrust so that the cutter does not require expensive, heavy, and excessive space consuming bearings.

Yet another object of this invention is to provide an improved bearing design which may be pressure compensated for reliable lubricating when in submerged operation.

A still further object of this invention is to provide a disc cutter head which makes it possible to reduce the size of a drill bit utilizing disc cutter technology.

Another object of this invention is to provide a carbide tipped disc cutter which wears at an optimum rate and in an optimum pattern to maintain cutting efficiency throughout the life of the cutter.

Yet another object of this invention is to provide a hard insert such as tungsten carbide in a geometry which preserves the disc cutting efficiency by the use of improved continuous segments.

Other objects of the invention will be apparent hereinafter. The invention accordingly comprises the provision of a superior disc cutter design, an improved drilling method incorporating the use of the improved disc cutter design, and an improved carbide bit for the disc cutter which maintains high cutting efficiency throughout the life of the cutter.

Description

The present invention will now be described by way of example, and not limitation, it being understood that a small diameter rolling type disc cutter with a long wearing blade, and cutterheads advantageously employing the same, may be provided in a variety of desirable configurations in accord with the exemplary teachings provided herein.

Basic Disc Cutter Details

Attention is now directed to FIGS. 7, where our novel disc cutter is shown by way of an exploded cross-sectional view, to FIG. 8, where the same embodiment is shown in a perspective view, and to FIG. 9, where the same embodiment is shown in an assembled cross-sectional view. Our novel cutter will be easily understood by evaluation of these three figures.

The cutter 120 is comprised of five (5) major parts:

First, a large diameter shaft 122 is provided.

Second, a washer surface 123, preferably hardened, is required. (Washer surface 123 is here shown as provided by optional ring type washer 124 rather than provided as an integral washer surface 125 as part of the shaft 122 structure, as seen in FIG. 7A.)

Third, a cutter ring assembly 126 is provided. When assembled, nested within the cutter ring assembly 126 are the cutter ring 128, bearing 130 (including inner 132 and outer 134 race) and seal 136 (here all shown individually in exploded view). The cutter ring 128 is the ring which runs against a rock to be cut and imparts the cutting action described above.

Fourth, a retainer 138 retains the ring assembly 126 onto the shaft 122. Retainer 138 is secured in place by fasteners such as machine screws 140, which in turn pass through fastener apertures in retainer 138 and are received by threaded receptacles 142*a*, 142*b*, and 142*c* (see FIG. 8) in the end 144 of shaft 122.

Fifth, a hubcap 146 is affixed to the outer side 148 of cutter ring 128 by securing means such as threads 150 (on hubcap 146) and 152 (in cutter ring outer side 148) Although threads 150 and 152 are shown, those skilled in the art will appreciate that other substantially equivalent securing means such as a snap ring arrangement may also be utilized. The hubcap 146 rotates with the cutter ring 128 and thus eliminates the need for an outer seal. The clearance between the interior wall 154 of hubcap 146 and the outer end 156 of fasteners 140 is minimal and prevents the fasteners 140 from backing out should they happen to loosen. The hubcap 146 also serves as a cover for an interior oil or grease reservoir 158 (see FIG. 9).

Thus, the overall cutter assembly 120, contains but five (5) major parts. This is a significant reduction in parts when compared to many conventional prior disc cutters heretofore known which contain as many as twenty (20) or more parts. Moreover, the parts provided are at greatly reduced weight when compared to prior art disc cutters.

The hard washer 124 described above is utilized as a replaceable wear surface on which the seal 136 rubs. However, it is to be understood that washer 124 is an optional part depending upon the selected use and desired economic life cycle of the disc cutter or body 120. However, in the embodiment as illustrated in FIG. 7, when a ring assembly 126 is replaced, the bearing 130 and seal 136 are replaced as well. All wear components, except the above described hard washer 124, are thus contained in the single ring assembly 126. Yet, even the hard washer is easily accessed when the ring assembly 126 is changed, thus easy maintenance of the disc cutter 120 is achieved.

Disassembly of cutter 120 can be accomplished with use of simple, common hand tools. Reassembly of cutter 120 is accomplished with equal ease. The worn cutter ring assembly 126 which preferably weighs less than forty (40) pounds; more preferably the cutter ring is provided in a weight less than twenty (20) pounds; most preferably the cutter ring is provided in the range of three (3) to eight (8) pounds (for a five (5) inch diameter disc cutter). Therefore, the cutter assembly 126 weighs in the range of approximately one tenth (1/10th) or less of the weight of conventional prior art disc cutters. Cutter ring assembly 126 is thus quite portable, even in quantity, and is easily handled in the field by a single workman without need of power lifting or carriage tools. Also, the cutter ring assembly 126 is sufficiently inexpensive that a worn ring assembly 126 may be simply discarded, rather than rebuilt. To install a new ring assembly 126, the ring assembly 126 is slid onto the shaft 122, the retainer 138 is secured, and the hubcap 146 is installed.

Further details of the cutter 120 may also be seen in this FIG. 7. At the inward 160 side of shaft 122, a retaining wall 162 is provided. When a wear ring 124 is utilized, the outer edge 164 of the wall 162 is provided with a shoulder portion 166 sized in matching relationship with the inner wall 168 diameter of wear ring 124. Also, retaining pins 170 are provided to insert through apertures 172 provided in wear ring 124, to secure wear ring 124 against rotation.

Seal 136 is sized to fit within a seal receiving portion 174 of cutter ring 128. An outer shoulder 176 of cutter ring 128 extends inwardly in the axial direction to the above (toward the outside) seal receiving portion 174. The outer shoulder 176 includes a lower seal portion 178 and an inward surface 180.

Below the seal receiving portion 174 of cutter ring 128 is a bearing retainer portion 182 which extends radially inward at least a small distance so as to prevent the advance of bearing 130 all the way through cutter ring 128 upon assembly. An interior sidewall 184 of ring 128 is sized in matching relationship to the outside diameter of the outer race 134 of bearing 130, so that the bearing 130 fits snugly against interior sidewall 184.

Retainer 138 may include an inwardly extending outer edge portion 186 which is sized and shaped to match the appropriate portions of the selected bearing 130 so as to allow proper freedom of bearing movement which securing the bearing 130 in an appropriate operating position. Also, one or more lubrication apertures 189 may be provided to allow lubricant to migrate to and from lubricant reservoir 158 (see FIG. 9).

Hubcap 146 may include a threaded plug 188 for use in providing lubrication as selected depending upon the type of service of the disc cutter 120. As more clearly visible in FIG. 8, hubcap 146 may be provided with a purchase means such as slot 190 for enabling application of turning force as necessary to turn the hubcap through threads 150 and 152 so as to tighten the hubcap. Also, hubcap 146 may also include a shoulder 191 or other diameter adjusting segment to allow internal clearance with retainer 138.

For underwater applications, a grease type lubrication system is normally provided with a pressure compensation membrane 192 and interconnecting lubricating passageways 194 defined by lubricating passageway walls 196. Also seen in any of FIGS. 7, 8, or 9, a pedestal 198 is provided for integral attachment of the cantilevered shaft 122.

It is important to note that shaft 122 is of large diameter SD in proportion to the outside diameter OD of the cutter 120. For example, with a five (5) inch diameter OD disc cutter, the shaft 122 diameter SD would preferably be at least forty percent (40%) of the cutter 120 diameter OD, or at least two (2) inches diameter. A large ratio of shaft 122 diameter SD to cutter diameter OD ratio is important to provide a sufficiently stiff shaft to minimize possible deflection of shaft 122.

Our novel cutter 120 design can also be described in terms of the minimal radial space required for bearing purposes. Again, for an exemplary five (5) inch diameter OD cutter, when using a needle type bearing as illustrated in FIGS. 7, 8, and 9, the total bearing space ($B_2$+$B_2$) would occupy about twenty percent (20%) of the total diameter OD (or also about twenty (20%) of the total radial space). The ratio of shaft diameter SD to cutter ring diameter OD is preferably over 0.4 (i.e, the shaft diameter is at least 40% of the cutter ring diameter). More preferably, the ratio of the shaft diameter to cutter ring diameter is in the range of 0.4 to 0.5 (i.e., the shaft diameter SD is forty to fifty percent (40–50%) of the diameter OD of the cutter ring 128. Using the desired shaft size or better in conjunction with the other design features illustrated provides extreme rigidity to the shaft 122, thus substantially minimizing shaft deflection when the cutter 120 is under load and thrusting against a rock face. Shaft deflection has historically been a major cause of early bearing failure in disc cutters, particularly when roller bearings were used as in the prior art device shown in FIG. 6 above.

With respect to the desirable size of cutters 120 in the design just illustrated, we can provide cutter rings 120 in various sizes. However, cutter rings of less than about twenty (20) inches diameter, and preferably in the range of about fourteen (14) inches diameter and smaller, and more preferably in the range of about nine (9) inches diameter or smaller, and most preferably in the five (5) inch diameter range or smaller, are desirable. These sizes are considered practical for currently known applications, although our disc cutter design could be provided in any convenient size.

Laboratory Testing

The first tests of a five (5) inch diameter cutter fabricated in accord with the present invention were conducted on the Linear Cutter Machine (LCM) at the Colorado School of Mines. A sketch of the LCM is provided in FIG. 10. This test machine 202 simulates the cutter action of an excavating machine by passing a rock sample 204 beneath the test cutter 200. Depth of penetration Y and spacing S can be set, while forces in three axis are measured (rolling force 206, normal force 208, and side force 210) as indicated in FIG. 11.

The LCM 202 has a spacing cylinder 212 for lateral movement of the sample, as well as cylinders (not shown) for moving the rock sample 204 horizontally kerf wise under the cutter. The depth of cut (penetration Y) is controlled by placing shims 214 between the cutter mount 216 and the LCM frame 218. A load cell 220 measures the forces on the cutter 200. The cutter 200 is supported by a saddle 221 (or pedestal, not shown) below the load cell 220. The rock sample 204 (or 204') is held in a rock box 222, which is in turn supported on a sled 224 suitable for transport of the rock sample 204 back and forth, and at a desired spacing S (via way of spacing cylinder 212) below the cutter 200.

The nomenclature used for recording test data and general appearance of the rock sample 204 are set forth in FIG. 12. In general, multiple cuts are made across rock sample 204 at spacing S, with penetration Y. Each complete pass (here shown as pass 1 through pass 5) results in removal from rock 204 a thickness Y.

Initial results are shown in TABLE I and TABLE II. The first rock sample 204 used was an extremely hard gneiss (about 43,000 psi compressive strength) rock. The second rock 204' was a 23,000 psi compressive strength welded tuff.

TABLE I

| Pene-tration (inches | Spacing (inches) | Avg. Thrust Force (lbs) | Avg. Side Force (lbs) | Specific Energy HP-hr/yd3 |
|---|---|---|---|---|
| | Five (5) inch Diameter Cutter Performance 43,000 psi Rock | | | |
| 0.075 | 0.75 | 8,515 | 332 | 31.9 |
| | 1.00 | 9,613 | 599 | 29.1 |
| 0.100 | 0.75 | 9,968 | 533 | 30.5 |
| | 1.00 | 10,347 | 721 | 24.4 |
| 0.125 | 0.75 | 10,878 | 828 | 30.2 |
| | 1.00 | 11,103 | 834 | 23.7 |

TABLE II

| Pene-tration (inches | Spacing (inches) | Avg. Thrust Force (lbs) | Avg. Side Force (lbs) | Specific Energy HP-hr/yd3 |
|---|---|---|---|---|
| | Five (5) inch Diameter Cutter Performance 23,000 psi Rock | | | |
| 0.10 | 1.5 | 8,062 | 316 | 11.08 |
| | 2.5 | 8,217 | 367 | 7.79 |
| | 3.0 | 9,102 | 384 | 7.43 |
| 0.15 | 1.5 | 8,845 | 566 | 10.2 |
| | 2.5 | 11,379 | 762 | 7.04 |
| | 3.0 | 11,956 | 302 | 6.61 |

Conclusions from Testing and Relevance to Key Design Objectives

Those experienced in disc cutter application and testing will appreciate that the thrust and side forces of our novel disc cutter, as set forth in the test data in TABLE 1 and TABLE 2, are extremely low in comparison with those forces which would be experienced with a conventional disc cutter, such as a 17 inch disc cutter of the type shown in FIG. 6 or in the in the Fikse patent, for example. TABLE III below shows comparison results in the same rock (23,000 psi welded tuff) between our disc cutter design and a disc cutter designed by the Robbins Company (similar to that shown in FIG. 6 above), when both cutters operate at a spacing of three (3.00) inches. As is evident from TABLE III, our novel cutter achieves the same penetration with substantially reduced thrust. Also, our cutter accomplishes the same penetration with substantially reduced side loading, here a little less than three (3) percent of thrust, as compared to about ten (10) percent on the prior art Robbins Company cutter.

The significance of this thrust reduction can be readily understood by considering a nominal six (6.0) foot diameter cutterhead. If a three (3) inch kerf spacing across a rock face were desired, a typical six (6.0) foot cutterhead would have fourteen (14) cutters and might rotate at about twenty (20) revolutions per minute ("rpm"). If conventional seventeen (17) inch cutters were used, as based on the data shown in TABLE III, total thrust on the cutterhead would be:

$$14 \times 42{,}200 = 590{,}800 \text{ pounds force}$$

If our novel disc cutter as described herein were used, the total thrust would be:

$$14 \times 11{,}956 = 167{,}384 \text{ pounds force}$$

In both cases, the boring machine penetration rate through the rock would be equal, at 0.15 inches per revolution, or fifteen (15) feet per hour. Yet, the thrust required for prior art excavating equipment using prior art type seventeen (17) inch disc cutters is 590,800 pounds force, while the thrust requirements for a cutter head using our novel disc cutter design is only 167,400 pounds force. Therefore, it can be appreciated that substantial reductions in excavation equipment structure, weight, thrust cylinder size, and operating power requirements are made possible by use of our novel disc cutter design.

TABLE III

| Cutter Type | Penetration (inches) | Thrust (lbs. force) | Side Force (lbs) |
|---|---|---|---|
| COMPARISON WITH PRIOR ART CUTTERS | | | |
| Our new 5" cutter | 0.15 | 11,956 | 302 |
| Robbins Co. 17" cutter with 0.5" wide blade | 0.15 | 42,200 | 4,200 |

Note:
Spacing ("S") = 3.0 inches

Referring now to FIG. 7B, preferably our novel disc cutter ring 240 is provided with a blade width W of less than about one-half (0.5) inches, and more preferably, our novel cutter ring 240 is provided with a blade width of less than about 0.4 inches, and most preferably, a relatively thin blade (0.32" to 0.35" in width) is provided. The most preferred blade width penetrates into a rock with less thrust force requirement than the one-half inch and large width blades (0.5" to 0.8" blade widths most commonly used) found in conventional prior art disc cutters.

Also, our relatively small cutter blade ring 240 outside diameter OD—preferably in the five inch range—as well as the preferably substantially smooth transverse cross-sectional shape, more preferably sinusoidal cross-sectional shape, and most preferably semi-circular transverse cross-sectional shape of the cutter blade tip (here shown with a radius $R_7$) reduces side loading. Whereas conventional cutters normally show a side load of about one tenth (0.1) of the thrust load, our new cutter ring 240, and similar cutter ring 128 discussed above, provides a side load somewhat less than one tenth of thrust load, and generally provides a side loading of about 0.06 times the thrust loading, or less.

The reduced side loading has allowed utilization of novel bearing construction in our rolling disc cutters. The bearing means utilized can be any one of a variety of bearings selected with regard to cost and load capability. We have found that with the relatively low side loads encountered, a needle type bearing provides sufficient bearing capability at relatively low cost. The needle type bearing accepts a high thrust load at low speeds (generally under 200 RPM) but is not tolerant of high side loading or axial loads. Therefore, our cutter design which minimizes side load is significant in reducing bearing costs and important in attaining adequate overall reliability of the bearing. One bearing make and model which has proven to provide satisfactory service during our testing has been a Torrington model 32 NBC 2044 Y2B needle bearing, which is used with a Veriseal teflon type seal manufactured by Busak+Shamban model S 67500-0177-42.

Use of the needle type bearing achieves one key design objective of our cutter because it requires a very small amount of radial bearing space, noted, for example, as $B_2$ above in FIG. 7. The needle type bearing is particularly an improvement over the double row, tapered roller bearings design used in prior art cutters such as is illustrated in FIG. 6 or in the Fikse patent. The radial space thus saved by our bearing design allows the use of a relatively large diameter shaft, thus enabling achievement of another key design objective. The large shaft minimizes shaft deflection when under load, to a degree which easily permits the use of a cantilever mounted cutter assembly, rather than saddle mounted cutter assembly. The cantilever shaft (axle) arrangement also helps achieve another key design objective, namely simplified assembly and disassembly of the cutter. Finally, the cantilever axle mounting arrangement allows the disc cutters to be mounted in a closely spaced pattern which provides close kerf spacing, as frequently desired in rock drilling type applications.

Improved Cutter Ring Design

The cutter ring 128 is the component which is pushed with great force against the rock face, and which causes the rock chipping action. The cutter ring 128 (or similar ring 240 as in FIG. 7B) is thus subject to wear, which is greatest when the cutter ring 128 attacks a rock containing quartz and other hard crystalline minerals. Nevertheless, a simple alloy steel ring 128, as illustrated in FIGS. 7, 8, and 9, when hardened to 57–60 Rockwell "C", is satisfactory in limestone, for example. However, such a hardened cutter ring 128 shows signs of rapid wear in a welded tuff material containing 25–30% quartz. Therefore, when excavating such materials, a much harder, wear resistant cutter ring material is highly desirable.

FIG. 13 shows a cross-sectional view of another embodiment of our novel disc cutter in which a cutter ring 250 is provided which has a hard metal insert 252 as the cutting edge, or blade 254. This cutter blade 250 design not only wears longer than the above described alloy blade 128, but it is also "self sharpening."

As the hard metal insert 252 wears, the metal walls 256 and 258 which support the insert 252 also wears, to shapes shown as 256' and 258' in FIG. 14. However, the blade 254 width W remains constant, as is illustrated in the worn blade 254' illustrated in FIG. 14.

In contrast to our novel hard metal cutter blade 254 design, all prior art all metal rings known to us, as well as common prior art button type insert cutters, present an increasingly blunter cutter surface to the rock as wear progresses. FIG. 15 illustrates such a prior art all metal disc cutter 260 with a tip 262 width $W_{P-1}$ when new. This is similar to the prior disc cutter shown in FIG. 6 above. After substantial wear, the result is a broadened and flattened cutter blade 262' of width $W_{P-2}$, as shown in FIG. 16. Thus, FIG. 16 illustrates a standard wear pattern which is normally evident in prior art all metal type disc cutter blades, when ready for blade replacement. The worn cutter blade width $W_{P-2}$, being wider than the new cutter blade width $W_{P-1}$, will, with equal pressure, not penetrate the rock as well. This increasing cutter blade width accounts for the significant and well known drop off of performance as prior art cutters wear out.

Another technique which has heretofore been tried by others for enhancing cutter life is illustrated in FIG. 17 and 17A. Button type inserts 270, with conical or chisel shaped outer ends 272, were inserted into cutter rings 274. Unfortunately, the button end 272 and the edge 276 of ring 274 became rather flat, as best seen by the shape of edge 276' in FIG. 17A. Therefore, although the wear life may have been enhanced to some limited degree in that design, the ultimate result was still a precipitous drop off in rock cutting performance as the cutter wore out. Further, a common failure occurred by shearing off the carbide button as the metal supporting structure wore away.

In contrast to prior art designs, FIG. 19 shows an axial cross-sectional view of our novel disc cutter design (here shown in vertical position with cutter ring 280 ready to cut at the bottom position 281) which was successfully tested at the Colorado School of Mines Laboratory. This embodiment is essentially identical to the embodiment first illustrated in FIGS. 7, 8, and 9 above, except that prior cutter ring 128 is here replaced by cutter ring 280. The cutter ring 280 includes a disc shaped body 282 having an outer edge 284. The body 282 includes opposing outer side wall portions 286 and 288. The opposing outer side wall portions 286 and 288 each further include an interior wall, 290 and 292, respectively, and an exterior wall, 294 and 296 respectively. The body 282 also includes a bottom edge surface 298 which interconnects with the interior walls 294 and 296 of the opposing outer side wall portions 286 and 288. The opposing outer side wall portions 286 and 288 extend substantially radially outwardly relative to the bottom edge surface 298 to thereby define a peripheral groove 300 penetrating the outer edge 284 of the disc shaped body 282. The interior walls 294 and 296 are spaced above the bottom edge surface 298, preferably so that the walls 294 and 296 extend adjacent in close fitting fashion alongside of preferably more than half and more preferably about seventy five (75) percent of the height ($R_1$–$R_2$) of the hard metal insert 302.

With respect to materials of construction, the hard metal inserts 302, as better shown in FIG. 18, can be made with current tungsten carbide manufacturing methods or other wear part materials that are known to those skilled in the art.

However, with respect to the exact shape required for hard metal inserts 302, it is to be understood that inserts 302 must be carefully configured in order to achieve long service life, as the precise size and shape of the inserts have considerable influence upon their longevity. To that end we have done considerable work and investigation, the results of which are set forth herein, in order to determine an exemplary insert 302 shape which results in an acceptable service life. Set forth in the transverse cross-sectional view of FIG. 18 is one possible configuration for providing hard metal inserts 302. In FIG. 18, it can be seen that twelve (12) inserts 302, each substantially in the shape of a segment of an annulus having an outer diameter $R_1$ and an inner diameter $R_2$, can be provided for mounting on a cutter ring 280 with shaft radius of size $R_9$ and insert slot radius $R_{2'}$. While it may be desirable to have the inserts 302 built in circumferentially larger angular segments, or even as a single annular piece, in view of current tungsten carbide insert manufacturing techniques, extremely large angular segments would be rather difficult to produce. However, a hard metal insert design with at least as few as four segments 302', as illustrated in similar transverse cross-sectional view FIG. 18C, is believed feasible utilizing current manufacturing technology and the design techniques taught herein.

The precise configuration of each segment 302 was also the subject of research, as we found that it was necessary to carefully construct the segments in order to avoid their premature failure. We have discovered that is is significant in the design of the outer surface 310 of each hard metal insert segment that careful attention be paid to three or more important radii. Referring now to FIG. 18A, $R_1$ is the desired radius of the cutter disc 280 (for example, 5 inches outside diameter OD in one tested embodiment). The bottom 312 of insert 302 has a radius $R_2$, which is sized and shaped to match groove 300, formed by bottom 298 wall of radius $R_{2'}$ and side walls 290 and 292 of radius $R_8$. With cutter rotating in the direction of reference arrow 314, a trailing edge 316 of the segment 302 is provided with a curvature $R_3$ which is slightly reduced from radius $R_1$. At the end 318 of insert 302, another well rounded radius $R_5$ is required. We have found that it is desirable that $R_5$ be no less than about 0.065 inch when $R_1$ is five (5) inches. Normally, segments 302 are manufactured symmetrically, and therefore leading edge 320 is provided with radii $R_4$ and $R_6$, which preferably correspond to radii $R_3$ and $R_5$, respectively. Without use of curved portions including each of the mentioned radii, any insert segments superficially similar to exemplary segments 302 have been found subject to premature cracking or catastrophic failure.

In addition to the just described radii, it is important to provide a slight gap 322 between hard metal segments 302. Because the co-efficient of thermal expansion of steel alloy cutter ring 280 and the hard metal inserts 302 are different, temperature cycling will crack the segments 302 unless slight relative movement is allowed between the segment 302 and the cutter ring 302. The selected fabrication method must allow for this minute movement to occur.

Also, the finite thickness T ($R_2$–$R_{2'}$) and ductile composition (modulus of elasticity) of the braze alloy or solder 330 used to secure the segments 302 is significant. This finite thickness T and ductile composition both cushions the hard metal inserts 302 and allows the small relative movement between the hard metal inserts 302 and the base cutter ring 280 material.

Variations in the size of the hard metal insert 302, but still showing the overall desired smooth, rounded, preferably sinusoidal, and most preferably semi-circular (with radius $R_{7'}$) transverse cross-sectional shape of insert 302, are shown in FIGS. 18B and 19A. A cutter 280 which is ready for rock cutting operations is illustrated with an external view in FIG. 20 (here considered as a top view in comparison to the side view provided in FIG. 19). Hard metal insert segments 302 in cutter ring 280 are illustrated in their working position, ready for rock cutting operations.

During tests, a disc cutter 400 with cutter ring 280 having hard metal insert segments 302 installed as shown in FIGS. 18 and 20 exhibited virtually identical performance to a new, solid steel cutter ring (ring 128 above). The continuous blade formed by hard metal inserts 302 performs as the principal contact surface between the disc cutter 400 and the rock being cut, without significant gaps in contact between the rock and the hard metal inserts 302 during rolling action of the disc cutter ring 280.

In contrast to our disc cutter, conventional cylindrical "button" inserts (see FIG. 17 and above discussion) perform in an impact mode, and penetrate rock in a cratering fashion. That impact mode of rock excavation produces much smaller average chip sizes, and as can be concluded by reference to FIG. 2 above, such prior art button type inserts consume greater amounts of energy to excavate a given volume of rock than our disc cutter, particularly when continuous segment hard metal inserts 302 are used, as illustrated in FIGS. 18 and 20. Moreover, as our hard metal insert 302 design preserves the efficient cutting action of a true rolling disc cutter over the working life of the cutter, (i.e., as insert 302 wears, the cutting radius $R_{7'}$ shape is substantially preserved during wear thereof to maintain a substantially uniform cutter footprint) we prefer using such hard metal insert type blades for most rock excavation applications.

To confirm the durability of our insert segment type cutter blade design, we conducted tests on the LCM (described above) at Colorado School of Mines. The insert segment cutter 400 of FIG. 20 was tested using carbide inserts 302 on a hard rock sample (43,000 psi unconfined compressive strength) at increasing penetration depths until failure of the segments 302 occurred. Finally, at an average thrust load of nearly 30,000 lbs. (and peak load of over 50,000 lbs.) and at a penetration of 0.30 inches, a hard metal insert 302 failed.

To illustrate the significant improvement in the state of the art which is provided by our novel disc cutter design, a computer simulation was used to estimate the force which would be required on a standard prior art seventeen (17) inch disc cutter to achieve 0.30 inch penetration in 43,000 psi rock. The computed force is over 100,000 lbs. thrust. However, on a prior art disc cutter, such thrust cannot be achieved using currently available materials of construction. Therefore, it can be appreciated that our disc cutter can provide the superior wear characteristics of a hard metal cutter (usually tungsten carbide) at rock penetration depths superior to any rolling disc cutter heretofore available. The ability of our novel disc cutter design to provide superior rock penetration at reduced thrust levels directly translates into the ability to cut rock at advance rates (i.e. lineal feet of rock cut per hour) superior to any disc cutter or cutterhead apparatus currently known to us.

In further confirmation of the excellent, and indeed striking improvement in the state of the art provided by our novel cutter design, the computer simulation further showed that at 30,000 lbs. thrust load, the standard prior art seventeen (17) inch cutter would penetrate only 0.03 inches, or about one tenth (1/10) of the rock penetration of our new disc cutter 400 design. Thus, our new cutter 400 design has the potential of increasing penetration Y on a cutterhead or drill bit by a factor of 10, when operating at a comparable thrust loading.

This superior performance was demonstrated in the Colorado School of Mines laboratory on a full scale (32 inch diameter) drill cutterhead 420, of the type illustrated in FIGS. 21 and 22. Cutterhead 420 is mounted on shaft 421 to provide rotary motion to the cutterhead 420. As shown, cutterhead 420 contains twelve (12) of our five (5) inch diameter cutters 422. With 82.1 HP and 65,752 lbs. of thrust on the cutterhead 420, an advance rate of 33.6 ft/hr was achieved in 23,000 psi rock. Specific energy was 11.8 HP-hr/yd3 of rock excavated. This is the best rock cutting performance in hard rock of which we are aware, and to the best of our knowledge, it is the best rock cutting performance ever witnessed in the Colorado School of Mines laboratory on a cutterhead or drill bit.

Use of Small Diameter Cutters in Cutterheads

Although above in FIGS. 7, 9, and 19 above, our novel disc cutter 120 is shown mounted on pedestal 198, it is advantageous in some applications to avoid the use of a pedestal and instead directly affix the cutter 120 to a cutterhead. In FIGS. 21 and 22, the advantage of such an integral mounting technique can be seen in the construction of a protected, inset cutter arrangement which is particularly useful for drilling in broken ground or boulders. Cutterhead 420 is provided, and cutters 422 are mounted to body 424 via aft portions 425 of shaft 122. A cantilever mounted shaft 122 supports cutter 422 at or near the distal end of shaft 122.

As illustrated in FIGS. 21, 22, and 23, a further unique feature of a cutterhead 420 with integral shaft mounted cutters 422 is that cutter 422 to cutter 422 (kerf-to-kerf) spacing S can be varied on a given cutterhead 420. This is made possible (1) because the shaft 122 occupies a small frontal area on the body 424 of cutterhead 420, (in contrast to the total area required for use of a typical prior art saddle type cutter mount), and (2) because small diameter disc cutters are utilized, which enable the designer to incorporate a large number of shafts 122 in the cutterhead body 424, including shafts 122, for use in adding additional cutters 422. Therefore, when it is desired to decrease kerf spacing S, additional disc cutters can be mounted on such extra shafts 122, and, in combination with the use of spacers 430 of width Z on existing cutter shafts 122, a new smaller kerf spacing S can be achieved.

In FIG. 23, it can be seen that a clearance H is left between the cap 146 of the cutter 422 and the cutterbody 424, so that cap 146 and retainer 138 may be easily removed and the cutter ring assembly 126 replaced as necessary. With our novel cutter design, this replacement is easily accomplished with common hand tools.

Muck (cuttings) handling in our cutterhead designs is also simplified. That is because by placing muck scoops 426 on the front 427 of the cutterhead body 424, as well as side scoops 428 on the sides 429, the muck is picked up almost immediately, as it is formed. Thus, the regrind of the cuttings is substantially reduced, and therefore the efficiency of the cutter is greatly enhanced. With forward scoops 426, it is possible to gather up to 75% or more of the muck immediately, thus substantially improving cutter efficiency.

For micro-tunneling, box (blind) raising, raise drilling and tunnel boring, the problem of broken rock falling in on a cutterhead is a common and serious matter. Shielded face cutterheads, where the rolling disc cutters are recessed, and in some cases can be removed from behind the cutterhead, have been known and have been developed by others for large diameter tunnel boring. Such prior art designs have been shown to be very effective in poor ground conditions.

Attention is now directed to FIGS. 24 and 25. Our disc cutter and cutterhead designs permit a dramatic improvement in shielded face cutterhead technology. Namely, we have been able to extend the use of shielded face cutterhead technology to much smaller diameter cutterheads. Thus, shielded cutterheads with a novel and much simplified structural design are possible when using our disc cutter technology.

Two exemplary versions of our novel shielded cutterhead designs, which are configured so as to allow the loading, repair, or replacement of our disc cutters 422 from either the front (i.e, toward rock 448 face 449) or back (i.e., from behind the cutterhead), are shown in use in FIG. 24 (cutterhead 450) and FIG. 25 (cutterhead 452). Configuration of cutterheads 450 and 452 were designed specifically for micro-tunneling in varying applications, ranging from solid rock 448 to soft ground with boulders.

As shown in FIGS. 24 and 25, our novel disc cutter—see for example cutters 422*a* and 422*b*—can also be mounted by directly welding the cutter shaft 122 into a cutterhead 450 or 452. In that case, no saddle or pedestal is used, and the shielded, recessed cutter configuration, heretofore successful almost exclusively in tunnel boring applications can, by use of our novel cutterhead and small diameter rolling disc cutter design, be applied to much smaller micro-tunneling and drilling applications. Shielded cutterheads even in the two (2) to four (4) foot diameter range are feasible, with about three (3) foot or slightly less diameter shielded cutterheads easily achievable. Thus, our unique shielded cutterhead design greatly simplifies how broken ground (shielded type) cutterheads are fabricated, since easy rear (behind the shield) access to the disc cutters can be provided.

Another important design feature of our cutterhead 450 and 452 design is that it is hollow: it is built like a one-ended barrel. Gusset plates (braces) 462, located respectively inside cutterheads 452, also function as internal buckets. A disc cutter mounting saddle, as used by others heretofore, can be advantageously eliminated by use of our pedestal mount type disc cutter design, or by direct attachment to the cutterhead body, as noted above for our stiff shaft cantilever design. This combination of features dramatically simplifies fabrication as compared with typical prior art shielded cutterheads, which are typically fabricated with box section type or frontal plate type construction.

In FIG. 24, shielded type cutterhead 450 is shown set up for use in a drilling fluid application. The cutterhead 450 is rotated against face 449 by shaft means 464, which is in turn affixed to cutter head body by braces 460. Cutterhead body 424 also includes a rear flange portion 466 which has an outer shield accepting flange 468. The shield accepting flange 468 rotates within the forward interior wall 470 of shield 472. A shield bulkhead 474 and shaft seal 476 prevent leakage of drilling fluid from flooded compartment 477 on the face 449 side of shield to the space rearward of the bulkhead 474. Drilling fluid indicated by reference arrow 478 is provided through bulkhead 474 to cutterhead 450 via inlet 480. In the hollow cutterhead 450 and through the cutterhead body 424, fluid picks up cuttings 482 and thence exits in the direction of reference arrow 484 past bulkhead 474 through outlet 486. The shield 472 and cutterhead 450 are advanced in a manner so that the forward interior wall 470 of shield 472 and the shield accepting flange 468 are maintained in shielding engagement with respect to the sides 488 of bore 490.

Another configuration for such an exemplary broken ground cutterhead is shown in FIG. 25. A nominal thirty two (32) inch diameter cutterhead 452 is illustrated. The hollow construction allows a muck removal system (not shown) to be inserted forward in the cutterhead 452, perhaps all the way to the inside 494 of cutterhead body 424, to a point as little as 8 inches from the rock face 449. The cutterhead 452 is compatible with a pneumatic muck system, or an auger, or a conveyor system. If an auger is used with a sealed bulkhead and water injector, the cutterhead 452 can be used as an EPB (Earth Pressure Balance) type drilling apparatus. In such cases, the hollow cutterhead 452 becomes the essential muck chamber. Cutterhead 452, as designed and illustrated, is thus suitable for use in drilling situations with high water inflow and hydraulic soil zones; it is also easily switched back and forth between the EPB drilling mode and an atmospheric or open drilling mode.

The cutterhead 452 set forth in FIG. 25 uses a downhole gear drive mechanism for providing rotary motion to cutterhead 452. The drive shaft 500 turns against a ring gear 502 which is affixed to cutterhead 452, and which, when rotated, rotates the cutterhead 452. A roller type radial bearing 504 separates the ring gear 502 and the shield support flange 506, to which shield 508 is attached. A roller type thrust bearing 510 is located between the shield support flange 506 and the bulkhead 512, to allow rotation of cutterhead 452 against the bearing 510, so that cutterhead 452 freely turns within the shield 508. Gear 502 and bearings 504, operate within an oil filled compartment 514, which is sealed by shaft seals 516 and by lip seal 520 between rotating bulkhead 518 and fixed bulkhead 522. For most applications, a chevron type muck seal 524 is provided between the forward interior wall 470 of shield 508 and bulkhead 512, and/or the adjacent axially extending outer shield accepting flange 468 the rear flange portion 466 of cutterhead body 424.

Small Diameter Drill Bits

Attention is directed to FIG. 26, where one embodiment of our novel drill bit 530 design is illustrated. As shown, the bit 530 is suitable for small bit sizes such as those in about the thirteen and ¾ (13.75) inches in diameter range or so. The bit 530 incorporates six (6) of our novel five (5) inch diameter cutter discs 422. This bit 530, similar bits which are somewhat smaller, or those which are larger and range in size up to about twenty three (23) inches or so in diameter (about the largest standard size prior art tri-cone bit), can advantageously replace conventional tri-cone drilling bits.

The design of bit 530 is nevertheless quite simple, due to use of our unique small diameter cutters 422. In the version of bit 530 illustrated in FIG. 26, six (6) of our novel disc cutters 422 are used to simultaneously cut into rock 448, at face 449, a bore 531 defined by borehole edge 532. Disc cutters 422 are outward (cutters 422*i*, 422*j*, 422*k*, and 422*m*), to provide the cut; those familiar generally with use of prior art rolling cutters will recognize that the exact placement of cutters 422 may be varied without departing from the teachings of our novel bit design. Usually a drill string 533 (shown in phantom lines) is provided to provide rotary motion to the bit 530 by connection with drill head 534 of bit 530. The drill head 534 is connected to a downwardly extending structure 536 (normally steel). The exact configuration of structure 536 is not critical, but may consist of a top plug structure 537, downwardly extending sidewalls 538, and the cutterhead assembly 539. Affixed below the cutterhead assembly 539 are disc cutters 422. Although we presently prefer to use a cutter pedestal 198 for each cutter 422 in order to maximize flexibility in number and location of cutters 422, other mounting configurations, such as described elsewhere herein, are feasible. Stabilizers 540 are affixed to the outward edges 541 such as at sidewalls 538 of structure 536 to position and secure the bit 530 with respect to borehole edge 532.

Because of the relatively low friction between the rolling disc cutters 422 and the rock 448 at face 449, and due to the relatively good heat dissipation by the rolling disc cutters 422, bit 530 can be used "dry", i.e., using only air as the cuttings removal fluid. When used in the dry mode, bottom cleaning of borehole 531 is accomplished by circulating a gaseous fluid such as compressed air. The air functions as both a cooling fluid and a muck or cuttings 542 transport media. Compressed air is supplied through a delivery tube 544 in the direction of reference arrow 546. The fluid enters the face area muck chamber 548 through a "blast hole" orifice or nozzle 550. Fluid is expanded into the face area 548. Cuttings 552 are forced out the muck pick up tube 554, in the direction of reference arrow 555, by air pressure or by vacuum. When desired, by use of both air pressure and vacuum, the pressure P in the face chamber 548 can be controlled. Additionally, it can readily be appreciated that the bit 530 can be converted to "wet" operation simply by supply of a liquid drilling fluid, instead of air, downward through tube 544, and sending the cuttings upward through muck tube 554.

The advantage of bit 530 and of our novel small diameter cutterhead design generally for use in conventional drill bit applications can more readily be appreciated by reference to recent test data. A typical tri-cone drilling bit was tested in cutting (a) aged hard concrete and (b) basalt, where, as is typically done, fine cuttings were produced. In aged hard concrete (about 6,000 psi strength) the tri-cone bit cut at a specific energy of 80 horsepower-hour per ton. In basalt (about 35,000 psi strength) the tri-cone bit operated at 120 horsepower-hour per ton.

Referring now to TABLE I, it can be seen that in tests conducted at the Colorado School of Mines, our novel disc cutter design, when operating on 43,000 psi rock at spacings of one (1.00) inches achieved a specific energy requirement between roughly twenty four (24) and twenty nine (29) horsepower-hours per cubic yard, (approximately 12 and 14.5 HP-hr/ton) depending upon the penetration Y achieved. In the same tests, when operating on 23,000 psi rock at one and one-half inch (1.5) spacing, our novel disc cutter achieved a specific energy requirement of ten (10) to eleven (11) HP-hour per cubic yard (approximately 5 to 5.5 HP-hr/ton).

Thus, by comparison of the specific energy requirements of prior art tri-cone drilling bits, and the specific energy of required for use of our novel disc cutters and cutterheads, one can readily appreciate that our novel disc cutter, when applied to a small drilling bit body such as bit 530, has the potential of improving the penetration rate by a factor of ten (10) or more at the same power input level.

Core Type Drill Bit

Attention is now directed to FIG. 27, where a unique coring drill bit 600, again using our novel disc cutters 422, is shown in cross-section. FIG. 28 shows a face view of bit 600, (taken looking upward from the line of 28–28 of FIG. 27.

In many respects, the core bit 600 is similar to bit 530 just described above, and with respect to such similar details, a detailed description need not be repeated for those skilled in the art to which this description is directed. In the core bit 600 as illustrated, six (6) of our five (5) inch nominal OD novel disc cutters 422 are used (only three visible in this FIG. 27 cross-sectional view—see FIG. 28 for further details) to simultaneously (a) drill a thirteen and three-quarters (13.75) inch diameter bore 602 defined by borehole edge 604 and (b) capture a four (4) inch diameter core 606. It can be readily appreciated that the dimensions provided are for purpose of example only, and are not in any way a limitation of the unique core drilling concept disclosed and claimed herein. Disc cutters 422*q* and 422*r* are angled outward, and cutter 422*s* is angled inward, to provide the desired annular, core 606 creating cut.

The drill head 614 (not completely shown here but similar in structure and function to that used in bit 530 above) is connected to a downwardly extending normally steel structure 616 to support the bottom cutter head assembly 618. Affixed below the cutter head assembly 618 are disc cutters 422, preferably by way of a cutter pedestal 198 for each disc cutter 422. Stabilizers 620 are affixed to the outward edges 621 of structure 616 to position and secure the bit 600 in the borehole 604.

Again, because of the relatively low friction between the rolling disc cutters 422 and the rock 448 at face 449, and due to the relatively good heat dissipation by the rolling disc cutters 422, bit 600 can be used "dry", i.e., using only air as the cuttings removal fluid. Operation is basically as described for bit 530 above, whether used "dry" or "wet."

In the center of the bit 600 grippers 629 of core catcher 630 secures the core 606 as it is formed. When the hole has been drilled approximately three feet (or a desired core length, depending upon bit 600 dimensions) the stab 632 is sent down the hole 602, assisted by weight 631. Weight 631 is connected to stab 632 by connection means such as shaft 633. The stab 632, by way of latch 634, fastens onto the core catcher 630. Latch 634 may include core catcher locking means such as latch pivot arms 636 and springs 638 for urging pivot arms 636 upward so as to prevent stab 632 from becoming disengaged from the core catcher 630 when the stab 632 is pulled up the bore 602. and is pulled to the surface upon completion of one drilling "stroke," using a wire line (not shown).

As mentioned above, bottom hole cleaning is accomplished by a circulating fluid, such as compressed air. Another unique feature of drill bit 600 is that both bore 602 and core 606 are located in dead end chambers. Particularly when air is used as the drilling fluid, no significant air or muck flow passes by either the core surface or the inside surface of the bore. Thus, contamination of either the core or bore is minimized, and an extremely clean core sample can be obtained by use of bit 600.

The performance of this core bit is expected to be far beyond ordinary diamond or carborundum type core bits. As can be seen from the performance test of TABLE I, at 0.10 inch penetration and 1.5 inch spacing, for example, and assuming 60 rpm, penetration of thirty (30) feed per hour is expected in rocks of about 25,000 psi compressive strength.

Cutter Repairs

In addition to the above described performance increases anticipated of about a ten fold drilling rate improvement, drill bits using our novel disc cutters are simple to rebuild. This markedly contrasts to prior art tri-cone bits, well known in the art, which are rebuilt in the following steps:

a. Saw the bit body into three sections.

b. Destructively remove the three cutters and pedestals.

c. Machine, jig and dowel the three bit body sections.

d. Install new cutters and pedestals, one on each section.

e. Re-weld the three sections.

f. Re-cut the threads.

g. Hard face cutting zones as required.

The rebuild process of prior art tri-cone bits is time consuming (several days or more), and requires a well equipped machine shop. Also, and the refurbished bit sells for about 75% of the cost of a new bit of equivalent size.

In contrast, when our novel disc cutter and drill bit design is used, the rebuild may be quickly accomplished in the field. By reference to FIG. 8 above, such a rebuild consists of the following:

a. Secure the bit (e.g. bit 600) [Mount the bit in a vise, or leave it on the drill rig].

b. Using a hammer, a wooden wedge and a crescent wrench, remove the old cutters ring assembly 126, by (i) removing the cap 146 from the cutter ring 148;

(ii) removing fasteners 140 from the retaining assembly 139;

(iii) removing the retainer 138;

(iv) removing the cutter ring assembly 126 from the shaft 122;

c. Clean the unit and replace the hard washers 124 if required (such as if scored);

d. replacing the removed cutter ring assembly 126 with a new or reconditioned cutter ring assembly 126;

e. replacing the retainer 138 and said fasteners 140;

f. replacing the cap 146;

g. hard face zones, such as cutter 148 sidewalls, as required.

The operator of the drilling unit does the work with his own field labor, on site, with common hand tools. The work may possibly be done even while the bit is still on the drill rig. Such rebuild can be done in about one hour by one man. Moreover, if hard facing is not required, total elapsed time is a mere fifteen (15) minutes. For convenience of the operator, a repair kit can be provided which includes one or more of the various wear parts, such as a cutter ring assembly (or its components of a annular cutter ring, a bearing assembly including a bearing, and a seal), a retainer assembly, a hubcap, or hardened wear ring washer. The most likely replacement part would be the annular cutter ring having hard metal inserts therein.

Other Embodiments

Attention is directed to FIG. 29, wherein the use of journal type bearing 700 is shown. This type of bearing 700 may be of the type with a base 702 and a wear face 704, or may be of unitary design. In some applications use of such a bearing 700 may further reduce the radial bearing space $B_2$ required for our novel disc cutter 422, and such bearing 700 is entirely serviceable for certain types of cutter 422 applications. Also, a simple bushing type bearing is of similar appearance to bearing 700 and can be utilized as desired, depending upon loads and service life required.

Although the design of our novel disc cutter allows the simplicity of assembly, replacement ease, unique cutterhead design and other benefits of a cantilevered design, our invention of small bearing space $B_2$ disc cutters is not limited to the cantilever mount design. Indeed, those skilled in the art will appreciate that by use of our basic cutter assembly design, appropriately modified such as is shown in FIGS. 30 and 31, can be provided in a traditional saddle mount, and still achieve many of the performance advantages set forth hereinabove. Consequently, we do not limit our invention to pedestal or cantilever mount designs, but also provide a novel disc cutter for saddle mount structures. Also, there are likely applications where our novel disc cutters may may need to be fitted onto conventional or existing cutterheads. By eliminating the hubcap 146, and by providing an extended shaft 700 and employing a second seal 136', a conventional saddle mount is easily provided. Dual mounting pedestals 705 extend from a cutterhead body 706. Pedestals 705 are shaped to accept shaft 700. Caps 707 secure shaft 700 to pedestals 705 via use of fasteners 708. An end plate 710 secures retainer 712 to shaft 700 by way of fasteners 714. End plate 710 also locates and secures retainer 712, which in turn secures one of the two hard washers 124'. Cutter ring 720 rotates about shaft 700 with cutting edge shape and performance as described above; also it is to be understood that the hard metal cutting edge as extensively described above can be adapted for use in an alternate cutter ring similar to ring 720, and need not be further described. Also, as set forth in FIG. 31, journal type bearings 700 can be substituted for the needle type bearing 130 shown in FIG. 30.

Thus our novel small diameter, minimal bearing space, and uniquely shaped cutting head disc cutter is not to be limited to a particular mounting technique, but may be employed in what may be the most advantageous mount in any particular application.

Similarly, although the research connected with the development of our novel disc cutter demonstrated the advantages of using the smallest diameter cutter possible in any given application, our novel cutter could be built in any desired diameter. Conceivably this may be necessary to fit into existing mounts of prior art excavating equipment.

Therefore, it is to be appreciated that the disc cutter provided by the present invention is an outstanding improvement in the state of the art of drilling, tunnel boring, and excavating. Our novel disc type cutterhead which employs our novel disc cutters is relatively simple, and it substantially reduces the weight of cutterheads. Also, our novel disc cutter substantially reduces the thrust required for drilling a desired rate, or, dramatically increases the drilling rate at a given thrust. Also, our novel disc cutter substantially reduces the costs of maintaining and rebuilding of cutterheads or bit bodies.

It is thus clear from the heretofore provided description that our novel disc cutter, and the method of mounting and using the same in a cutterhead, is a dramatic improvement in the state of the art of tunnel boring, drilling, and excavating. It will be readily apparent to the reader that the our novel disc cutter and cutterhead may be easily adapted to other embodiments incorporating the concepts taught herein and that the present figures as shown by way of example only and are not in any way a limitation. Thus, the invention may be embodied in other specific forms without departing from the spirit or essential characteristics thereof. The embodiments presented herein are therefore to be considered in all respects as illustrative and not restrictive, the scope of the invention being indicated by the appended claims rather than by the foregoing description, and all changes which come within the meaning and range of equivalences of the claims are therefore intended to be embraced therein.

We claim:

1. The combination of a shielded face cutterhead and a plurality of small diameter rolling disc cutters, said combination adapted for excavating a tunnel of preselected diameter, said combination comprising:

(a) a shielded cutterhead, said shielded cutterhead adapted for rotary movement about an axis of rotation which extends along a centerline of the tunnel;

(b) two or more rolling disc cutters, said rolling disc cutters configured for use in combination with said shielded cutterhead to exert pressure against substantially solid matter such as rock, compacted earth, or mixtures thereof by acting on a cutting face, said rolling disc cutters, upon rolling as a result of rotary movement of said shielded cutterhead, forming a kerf by penetration into said cutting face so that, when two or more rolling disc cutters are used, solid matter between a proximate pair of said kerfs is fractured to produce chips which separate from said cutting face, and wherein each of said two or more rolling disc cutters comprise (1) a stiff shaft, said shaft providing an axis for rotation of said rolling disc cutter thereabout, said shaft having (i) a proximal end directly protruding from said shielded cutterhead at an angle which allows said rolling cutter to address said cutting face, and (ii) a distal end, (2) a cutter ring assembly, said cutter ring assembly further comprising (i) an annular cutter ring having an interior annulus defining portion and an outer ring portion, said outer ring portion including a cutting edge having diameter OD and radius $R_1$ (ii) a bearing assembly, said bearing assembly adapted (A) to substantially fit into said annulus of said cutter ring, and (B) in a close fitting relationship with said shaft, so that said cutter ring may rotate with respect to and be supported by said shaft, (iii) said bearing assembly comprising (A) a bearing, and (B) a seal, said seal providing a lubricant retaining seal for said interior annulus portion of said cutter ring, (3) a retainer assembly, said retainer assembly adapted to retain said cutter ring assembly on said shaft, (4) a cap, said cap having an interior surface portion, said cap adapted to seal said interior annular portion of said cutter ring assembly, so that, in cooperation with said seal and said cutter ring, a lubricant retaining chamber is provided.

2. The combination as set forth is claim 1, wherein said cutting edge portion of said cutter ring further comprises a smoothly curved contact portion in transverse cross-section.

3. The combination as set forth in claim 2, wherein said transverse cross-section is symmetrical in shape.

4. The combination as set forth in claim 2, wherein said transverse cross-section is sinusoidal in shape.

5. The combination as wet forth in claim 2, or claim 3, or claim 4, wherein said transverse cross-section has a side-to-side width W of less than about 0.5 inches.

6. The combination as set forth in claim 2, or in claim 3, or in claim 4, wherein said transverse cross-section has a side-to-side width W of less than 0.4 inches.

7. The combination as set forth in claim 2, or in claim 3, or in claim 4, wherein said transverse cross section has a side-to-side width W in the range from 0.32 to 0.35, inclusive.

8. The combination as set forth in claim 2, wherein said transverse cross-section is substantially semi-circular.

9. The combination as set forth in claim 8, wherein said semi-circular cross-section has a radius $R_7$ selected from a value from 0.25 inches to 0.50 inches, inclusive.

10. The combination as set forth in claim 8, wherein said semi-circular cross-section has a radius $R_7$ selected from a value of less than 0.5 inches.

11. The combination as set forth in claim 8, wherein said semi-circular cross-section has a radius $R_7$ selected from and including 0.32 inches up to and including 0.35 inches.

12. The combination as set forth in claim 8, wherein said semi-circular cross-section has a radius $R_7$ of approximately 0.32 inches.

13. The combination as set forth in claim 1, further comprising at least one spacer with a width Z, and wherein said kerf spacing S is adjustable by a width Z by placement of said spacer on said shaft of said rolling cutter.

14. The combination as set forth in claim 1, wherein said shielded cutterhead comprises a forward side directed toward said cutting face, and a rearward side directed to a bore made by said shielded cutterhead, and wherein said rotating cutters are sufficiently lightweight so that said rotating cutters may be individually manually removed by a workman acting alone without lifting devices, and wherein said rolling cutters are manually removable from said shielded cutterhead.

15. The combination of a shielded face cutterhead and a plurality of small diameter rolling disc cutters, said combination adapted for excavating a tunnel of preselected diameter, said combination comprising:

(a) a shielded cutterhead, said shielded cutterhead adapted for rotary movement about an axis of rotation which extends along a centerline of the tunnel;

(b) two or more rolling disc cutters, said rolling disc cutters configured for use in combination with said shielded cutterhead to exert pressure against substantially solid matter such as rock, compacted earth, or mixtures thereof by acting on a cutting face, said rolling disc cutters, upon rolling as a result of rotary movement of said shielded cutterhead, forming a kerf by penetration into said cutting face so that, when two or more rolling disc cutters are used, solid matter between a proximate pair of said kerfs is fractured to produce chips which separate from said cutting face, and wherein each of said two or more rolling disc cutters comprise (1) a stiff shaft, said shaft providing an axis for rotation of said rolling disc cutter thereabout, said shaft having (i) a proximal end directly protruding from said shielded cutterhead at an angle which allows said rolling cutter to address said cutting face, and (ii) a distal end, (2) a cutter ring assembly, said cutter ring assembly further comprising (i) an annular cutter ring having an interior annulus defining portion and an outer ring portion, said outer ring portion including a cutting edge having diameter OD and radius $R_1$ (ii) a bearing assembly, said bearing assembly adapted (A) to substantially fit into said annulus of said cutter ring, and (B) in a close fitting relationship with said shaft, so that said cutter ring may rotate with respect to and be supported by said shaft, (iii) said bearing assembly comprising (A) a bearing, and (B) a seal, said seal providing a lubricant retaining seal for said interior annulus portion of said cutter ring, (3) a retainer assembly, said retainer assembly adapted to retain said cutter ring assembly onto said shaft;

(4) a cap, said cap having an interior surface portion, said cap adapted to seal said interior annular portion of said cutter ring assembly, so that, in cooperation with said seal and said cutter ring, a lubricant retaining chamber is provided;

(5) wherein said cutter ring further comprises:

(i) a pair of laterally spaced apart support ridges, said ridges having therebetween a groove forming portion, said groove forming portion including (A) a pair of interior walls, and (B) an interior bottom surface interconnecting with said interior walls, and (ii) wherein said interior walls outwardly extend relative to said interior bottom surface to thereby define a peripheral groove around the outer edge of said outer cutter ring, (6) two or more hardened, wear-resistant inserts, said inserts substantially aligned within and located in a radially outward relationship from said groove, said inserts further comprising (i) a substantially continuous engaging contact portion of radius $R_1$, said contact portion on the outer side of said inserts and adapted to act on said face, and (ii) a lower groove insert portion, said groove insert portion, (A) having a bottom surface shaped and sized in complementary matching relationship relative to said bottom surface of said groove, and (B) having first and second opposing exterior side surfaces, said first and second side surfaces being shaped and sized in a complementary matching relationship relative to said interior walls, (iii) a rotationwise front and rear portion, wherein said lower groove insert portion of said inserts fit within said groove in a close fitting relationship which defines a slight gap between said inserts and said interior walls, and (7) wherein a somewhat elastic preselected filler material is placed between and joins said inserts in a spaced apart relationship to said groove bottom and to said interior sidewalls, said preselected filler material having a modulus of elasticity so that said inserts can slightly move elastically relative to said cutter ring so as to tend to relieve stress and strain acting on said insert segments.

16. The combination as set forth in claim 1 or claim 15, wherein said retainer assembly further comprises (a) a retainer, said retainer comprising (i) an outer surface, and (ii) one or more retainer aperture(s) extending therethrough, and (b) one or more fastener(s)

(c) wherein said fastener(s) pass through said fastener aperture(s) and are received by threaded receptacle(s) at said distal end of said shaft.

17. The combination as set forth in claim 16, wherein said outer surface of said retainer and said inside surface of said cap are separated by a length L, and wherein said length L is sized so that said fastener(s) impinge said interior of said cap in the case that said fastener(s) back out from said shaft, so that said retainer will not substantially loosen even if said fastener(s) become slightly loosened.

18. The combination as set forth in claim 1 or claim 15, wherein said cap is affixed to said cutter ring assembly by a cap retainer that engages said cap and said cutter ring.

19. The combination as set forth in claim 18 wherein said cap retainer affixing said cap to said cutter ring assembly comprises interengaging threads in said cap and in said cutter ring.

20. The combination as set forth in claim 1 or claim 15, wherein said cap further comprises an exterior portion, said exterior portion including a tool engaging portion.

21. The combination as described in claim 20, wherein said tool engaging portion is adapted to be engaged by a hand tool, so that said cap may be easily affixed or removed by hand.

22. The combination as described in claim 21, wherein said tool engaging portion comprises a slot.

23. The combination as set forth in claim 1 or claim 15, wherein said cutter has a cutter ring outside diameter OD, and wherein said shaft has a shaft diameter SD, and wherein the ratio of SD to OD is 0.4 or greater.

24. The combination as set forth in claim 1 or claim 15, wherein said cutter comprises a cutter ring with an outside diameter OD, and wherein said shaft has a shaft diameter SD, and wherein the ratio of SD to OD is between 0.4 and 0.5, inclusive.

25. The combination as set forth in claim 1 or claim 15, wherein said bearing occupies a bearing radial space of $B_2$ on each side of said shaft, and wherein a total bearing space ($B_2$+$B_2$) is occupied, said total bearing space comprising approximately twenty (20) percent of the outside diameter OD of the cutter ring.

26. The combination as set forth in claim 1 or claim 15, wherein said bearing comprises a journal type bearing.

27. The combination as set forth in claim 1 or claim 15, wherein said radius $R_1$ is in the range from one and one-half (1.5) inches to ten (10) inches.

28. The combination as set forth in claim 1 or claim 15, wherein said radius $R_1$ is in the range from two (2) inches to four and one-half (4.5) inches.

29. The combination as set forth in claim 1 or claim 15, wherein said radius $R_1$ is approximately two and one-half (2.5) inches.

30. The combination as set forth in claim 1 or claim 15, wherein each of said rolling disc cutters in said combination further comprises (a) a bore defining interior sidewall running generally axially through at least a portion of said shaft to an opening at the distal end thereof, and (b) a compensator, (c) wherein the bore defined by said sidewall serves as a lubricant reservoir, said reservoir in fluid communication with (i) said lubricant retaining chamber and (ii) with said compensator, so that in response to external fluid pressure such as water pressure acting on said compensator, the pressure of said lubricant in said lubricant retaining chamber is substantially equalized to said external pressure, so as to prevent said external pressure causing fluid from tending to migrate into said lubricant retaining chamber.

31. The combination as set forth in claim 30, wherein said compensator is of the type comprising (a) a cylinder, or (b) a bellows, or (c) a bladder.

32. The combination as set forth in claim 1 or claim 15, wherein said cutter ring assembly is sufficiently lightweight that it is manually portable by a single worker.

33. The combination as set forth in claims 1 or 15, wherein said cutter ring assembly is 40 pounds (18.14 kg) or less.

34. The combination as set forth in claims 1 or 15, wherein said cutter ring assembly is 20 lbs. (9.07 kg) or less.

35. The combination as set forth in claim 1 or claim 15, wherein said cutter ring assembly is 8 lbs. (3.63 kg) or less.

36. The combination as set forth in claim 1, or in claim 15, further comprising two or more pedestal type mounts, wherein two or more of said rolling cutters are affixed to said shielded cutterhead by affixing each one of said rolling cutters to a pedestal mount.

37. The combination as set forth in claim 36, wherein each of said pedestal mounts further includes a proximal end for connection to said shielded cutterhead and a distal end, and wherein a shaft suitable for receiving a rotating disc cutter is affixed to each of said pedestal mounts at or near the distal end thereof.

38. The combination as set forth in claim 1, or in claim 15, wherein said shielded cutterhead is of hollow type construction.

39. The combination as set forth in claim 38, wherein said combination further comprises a mucking means, and wherein said mucking means is disposed less than 1 ft. (30.48 cm) from said face.

40. The combination as set forth in claim 1, or in claim 15, wherein said shielded cutterhead further comprises a sealed bulkhead, so that said cutterhead is operable as an earth pressure balance type drilling apparatus.

41. The combination as set forth in claim 1, or in claim 15, wherein said shielded cutterhead has a diameter of about four (4) feet or less.

42. The combination as set forth in claim 1, or in claim 15, wherein said shielded cutterhead has a diameter of about three (3) feet or less.

43. The combination as set forth in claim 1, or in claim 15, wherein said shielded cutterhead has a diameter of about two (2) feet or less.

44. The combination of a shielded face cutterhead and a plurality of small diameter rolling disc cutters, said combination adapted for excavating a tunnel of preselected diameter, said combination comprising:

(a) a shielded cutterhead, said shielded cutterhead adapted for rotary movement about an axis of rotation which extends along a centerline of the tunnel;

(b) two or more rolling disc cutters, said rolling disc cutters configured for use in combination with said shielded cutterhead to exert pressure against substantially solid matter such as rock, compacted earth, or mixtures thereof by acting on a cutting face, said rolling disc cutters, upon rolling as a result of rotary movement of said shielded cutterhead, forming a kerf by penetration into said cutting face so that, when two or more rolling disc cutters are used, solid matter between a proximate pair of said kerfs is fractured to produce chips which separate from said cutting face, and wherein each of said two or more rolling disc cutters comprise:

(1) an outer cutter ring, said cutter ring further comprising:

(i) a pair of laterally spaced apart support ridges, said ridges having therebetween a groove forming portion, said groove forming portion including (A) a pair of interior walls, and (B) an interior bottom surface interconnecting with said interior walls (ii) wherein said interior walls outwardly extend relative to said interior bottom surface to thereby define a peripheral groove around the outer edge of said outer cutter ring, (2) two or more hardened, wear-resistant inserts, said inserts substantially aligned within and located in a radially outward relationship from said groove, said inserts further comprising (i) a substantially continuous engaging contact portion of radius $R_1$, said contact portion on the outer side of said inserts and adapted to act on said face, and (ii) a lower groove insert portion, said groove insert portion, (A) having a bottom surface shaped and sized in complementary matching relationship relative to said bottom surface of said groove, and (B) having first and second opposing exterior side surfaces, said first and second side surfaces being shaped and sized in a complementary matching relationship relative to said interior walls, (iii) rotationwise, a rounded leading edge surface portion of reduced curvature relative to contact portion radius $R_1$, and a rounded trailing edge surface portion of reduced curvature relative to contact portion radius R, (iv)wherein said lower groove insert portion of said inserts fit within said groove in a close fitting relationship which defines a slight gap between said inserts and said interior walls, and (3) wherein a somewhat elastic preselected filler material is placed between and joins said inserts in a spaced apart relationship to said pair of interior sidewalls and said interior bottom surface, said preselected filler material having a modulus of elasticity so that said inserts can slightly move elastically relative to said cutter ring so as to tend to relieve stress and strain acting on said insert segments.

45. The combination as set forth in claim 15 or claim 44, wherein said inserts are comprised of hard metal.

46. The combination as set forth in claim 45, wherein said inserts are comprised of a hard metal capable of withstanding a peak thrust load of over 50,000 pounds.

47. The combination as set forth in claim 45, wherein said inserts are comprised of a hard metal capable of withstanding an average thrust load approaching 30,000 pounds.

48. The combination as set forth in claim 15 or claim 44, wherein inserts are comprised of hard metal, and wherein said inserts further comprise substantially annular shaped segments of outer radius $R_1$ and inner radius of $R_2$.

49. The combination as set forth in claim 48, wherein said hard metal inserts are fixedly secured in said groove with support of shims.

50. The combination as set forth in claim 15 or claim 44 wherein said preselected filler material is comprised of a ductile braze alloy, so that said inserts tend not to crack despite the difference in thermal expansion coefficients between said cutter ring and said inserts.

51. The combination as set forth in claim 15 or claim 44, wherein said inserts are sized and shaped so that a slight gap is provided between said inserts and said bottom and said interior walls of said groove, and wherein said brazing material substantially fills said gap, so as to cushion said bottom and said first and said second sidewalls of said insert from directly impinging upon said cutter ring.

52. The combination as set forth in claim 15 or claim 44, wherein said insert is comprised of hard metal, and wherein a slight gap is provided between said front portion of a first hard metal insert and said rear portion of a second hard metal insert, and wherein said gap is filled with a slightly elastic braze material.

53. The combination as set forth in claim 15 or claim 44, wherein said insert segments further comprise (a) a leading edge surface portion of radius $R_4$, (b) a trailing edge surface portion of radius $R_3$, (c) a leading edge corner portion of radius $R_6$, and (d) a trailing edge corner portion of radius $R_5$, (e) wherein said radii $R_4$ and $R_3$ are each slightly less than said radius $R_1$, so that a smooth curved leading edge and a smooth curved trailing edge is provided for each segment in the rolling direction.

54. The combination as set forth in claim 15 or claim 44, wherein said inserts are comprised of hard metal, and wherein said inserts further comprise a leading edge surface portion and a trailing edge surface portion, and wherein said leading edge surface portion has a radius $R_4$ slightly less than the outer radius $R_1$ of said annular segment.

55. The combination as set forth in claim 15 or claim 44, wherein said inserts are comprised of hard metal, and wherein said inserts further comprise a leading edge surface portion and a trailing edge surface portion, and wherein said trailing edge surface portion has a radius $R_5$ slightly less than the outer radius $R_1$ of said annular segment.

56. The combination as set forth in claim 15 or claim 44, wherein said opposing interior walls of said cutter ring provide lateral support to more than fifty (50) percent of the radial height of said first and of said second exterior side surfaces of said hard metal inserts.

57. The combination as set forth in claim 15 or claim 44, wherein said opposing interior walls of said cutter ring provide lateral support to approximately seventy five (75) percent of the radial height of said first and of said second exterior side surfaces of said hard metal inserts.

58. The combination as set forth in claim 15 or claim 44, wherein four (4) or more hard metal segments are provided.

59. The combination as set forth in claim 15 or claim 44, wherein said contact portions of said hard metal insert segments further comprise a smoothly curved contact portion edge in transverse cross-section.

60. A method for replacing wear parts in shielded cutterhead using rolling cutters, said shielded cutterhead having a cutting face side and a bore side, and of the type having integrally mounted shafts protruding from said cutterhead for rolling disc cutters to address a cutting face, and (a) wherein said rolling disc cutters are of the type comprising (1) a stiff shaft, said shaft having a proximal end and a distal end, and an axis for rotation of said cutter thereabout;

(2) a cutter ring assembly, said cutter ring assembly further comprising (i) an annular cutter ring having an interior annulus defining portion and an outer ring portion, said outer ring portion including a cutting edge having diameter OD and radius $R_1$ (ii) a bearing assembly, said bearing assembly adapted (A) to substantially fit into said annulus of said cutter ring, and (B) in a close fitting relationship with said shaft, so that said cutter ring may rotate with respect to and be supported by said shaft, (iii) said bearing assembly comprising (A) a bearing, and (B) a seal, (3) a retainer assembly, said retainer assembly adapted to retain said cutter ring assembly onto said shaft, (4) a cap, said cap adapted to seal said interior annular portion of said cutter ring assembly, so that, in cooperation with said seal and said cutter ring, a lubricant retaining chamber is provided; and (b) wherein said replacement method comprises:

(1) accessing said rolling disc cutter from the bore side of said shielded cutterhead;

(2) removing said cap from said cutter ring;

(3) removing said retaining assembly;

(4) removing said retainer;

(5) removing said cutter ring assembly from said shaft;

(6) replacing said removed cutter ring assembly with a new or reconditioned cutter ring assembly;

(7) replacing said retainer (8) replacing said cap.

* * * * *